US012296433B2

(12) United States Patent
Cheng

(10) Patent No.: US 12,296,433 B2
(45) Date of Patent: May 13, 2025

(54) SANDER CLAMPING MECHANISM

(71) Applicant: Allway Tools, Inc., West Babylon, NY (US)

(72) Inventor: Yuan Fang Cheng, Syosset, NY (US)

(73) Assignee: ALLWAY TOOLS, INC., West Babylon, NY (US)

( * ) Notice: Subject to any disclaimer, the term of this patent is extended or adjusted under 35 U.S.C. 154(b) by 339 days.

(21) Appl. No.: 17/651,385

(22) Filed: Feb. 16, 2022

(65) Prior Publication Data

US 2022/0258307 A1 Aug. 18, 2022

Related U.S. Application Data

(60) Provisional application No. 63/200,137, filed on Feb. 16, 2021.

(51) Int. Cl.
*B24D 15/02* (2006.01)

(52) U.S. Cl.
CPC ..... *B24D 15/023* (2013.01)

(58) Field of Classification Search
CPC .. B24D 15/02; B24D 15/023; B24D 18/0045; B24D 15/04; B24D 9/085; B24D 7/066
USPC ..... 451/344, 340
See application file for complete search history.

(56) References Cited

U.S. PATENT DOCUMENTS 6,634,937 B1 * 10/2003 Edwards ..... B24B 23/046 451/519
2007/0087673 A1 * 4/2007 Cybulski ..... B24D 15/023 451/514
2016/0167199 A1 * 6/2016 Arvinte ..... B24D 15/023 451/344

FOREIGN PATENT DOCUMENTS

CA 2618324 A1 * 7/2009 ..... B24D 15/023
WO WO-2018116288 A1 * 6/2018 ..... B24B 23/00

* cited by examiner

*Primary Examiner* — David S Posigian
*Assistant Examiner* — Tyler James McFarland
(74) *Attorney, Agent, or Firm* — Gottlieb, Rackman & Reisman, PC

(57) ABSTRACT

A sanding device includes a base, a plurality of protrusions extending from the base, a plurality of fasteners, a first one of the fasteners extending through the base, a clamping mechanism having openings through which the protrusions and the first one of the fasteners extend, and a spring arranged over the first one of the fasteners, between the base and the clamping mechanism. The clamping mechanism is releasably fixed in contact with the base in a first state and the clamping mechanism is spaced from the base in a second state while retained with respect to the base by at least a pair of the plurality of protrusions extending from the base to substantially prevent axial rotation of the clamping mechanism.

16 Claims, 20 Drawing Sheets

SANDER CLAMPING MECHANISM

CROSS-REFERENCE TO RELATED APPLICATION

This patent application claims benefit to U.S. Provisional Patent Application No. 63/200,137, filed Feb. 16, 2021, which is hereby incorporated by reference in its entirety as part of the present disclosure.

FIELD OF THE INVENTION

The present disclosure relates generally to a sanding device and more specifically to a self-lifting, non-rotational hand sander or pole sander clamping mechanism.

BACKGROUND OF THE INVENTION

Various devices are known that are used to secure sand paper to a pole or hand sander. Such devices include clamps and fasteners, such as screws, clips, wing nuts, etc. However, during use, existing designs fail to prevent clamping mechanisms from rotating off axis when the fastener that secures the clamp becomes loosened. Additionally, existing pole and hand sander designs fail to allow clamping mechanisms to lift automatically to allow room for sandpaper to slide under the clamp, as desired.

SUMMARY OF THE INVENTION

The present disclosure relates generally to a sanding device that comprises a non-rotatable, self-lifting clamping mechanism. More specifically, the sanding device include protrusions, which are spaced from each other and which are attached to or extend from a base of the sanding device, fasteners and clamping mechanisms that do not require alignment with each other. The protrusions can be L-shaped such that each protrusion extends substantially perpendicular to the base and then extend substantially parallel to the base. While the protrusions are shown as having an L-shape, as will be described in more detail below, they can have any shape that prevents axial rotation of the clamping mechanism and prevents the clamping mechanism from becoming disengaged from the sanding device when the fastener is not in place to secure the clamping mechanism to the base, unless desired.

The clamping mechanism includes a first opening and a second opening through which the first protrusion and the second protrusion, respectively, can extend in an assembled state and a third opening arranged between the first and second openings. The protrusions prevent the clamping mechanism from rotating off axis in a first, secured state and, in a second state, spaced away from the base.

The base includes a hole near the first end and the second end and through each hole a fastener can extend and interact with a first mating fastener (e.g., a nut) to secure the fastener to the base. The fastener is configured to receive a spring (e.g., a compression spring) and to extend through the third opening of the clamping mechanism. A second mating fastener, such as a wing nut, can interact with the fastener to secure the clamping mechanism in place with respect to the base. Alternatively, the first mating fastener can be eliminated and replaced by a projection which extends from the base in line with the hole near the first and the second end of the base.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF EMBODIMENTS OF THE INVENTION

Figure 1:
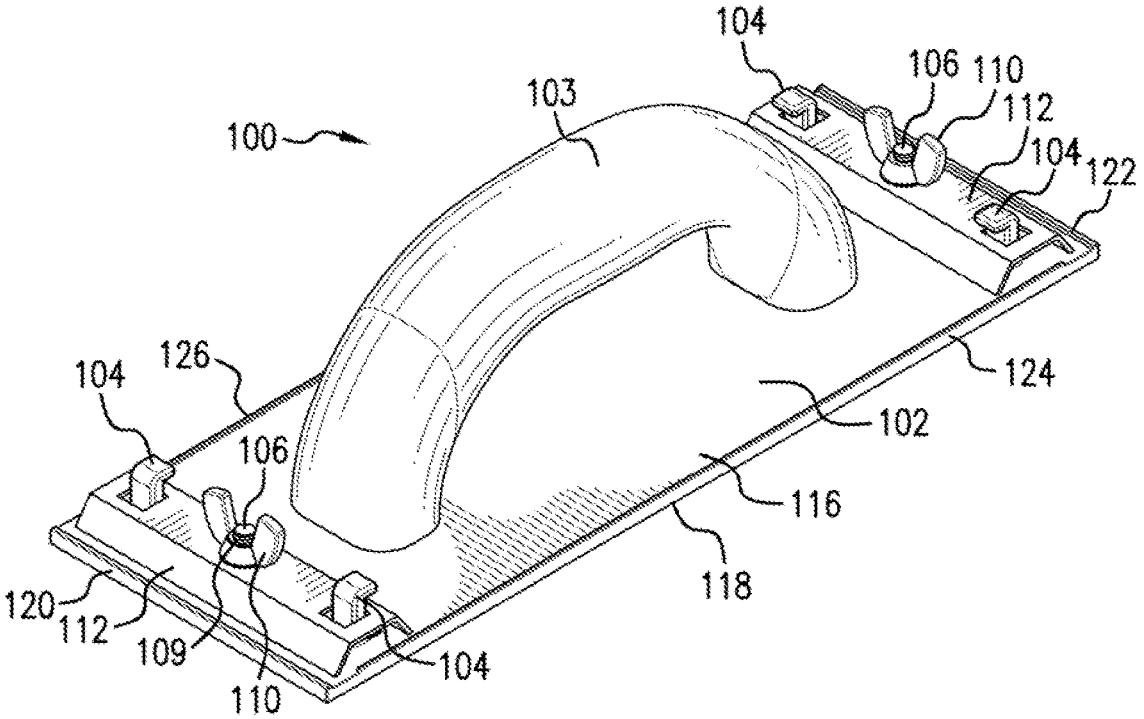
FIG. 1 is a perspective view of a sanding device according to according to an embodiment of the present disclosure.
Figure 2:
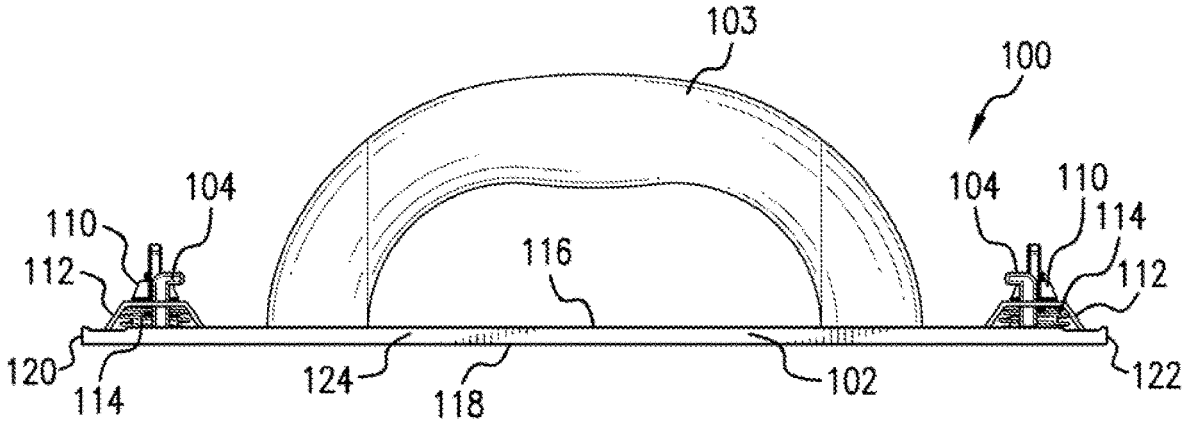
FIG. 2 is a side view of the sanding device of FIG. 1.
Figure 3:
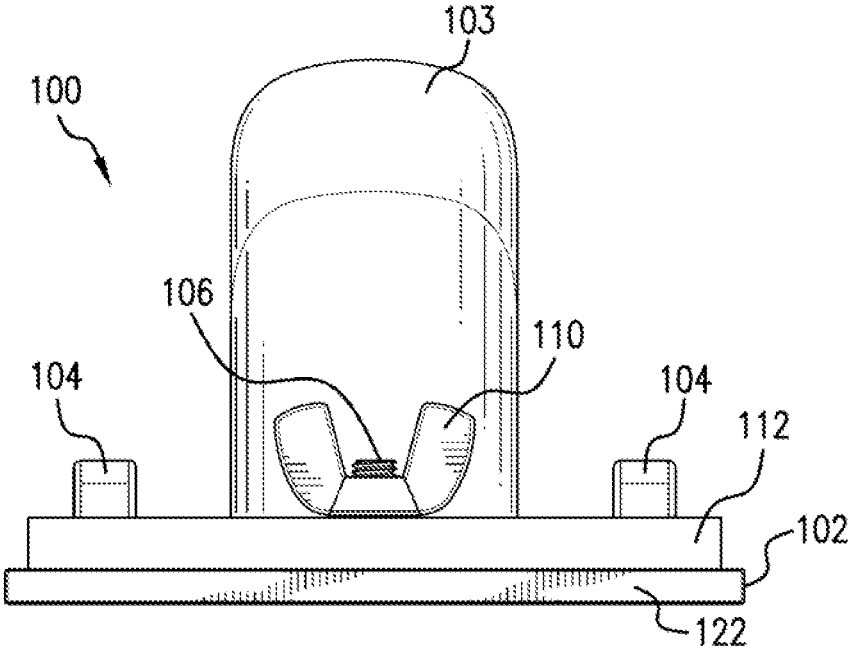
FIG. 3 is an end view of the sanding device of FIG. 1.
Figure 4:
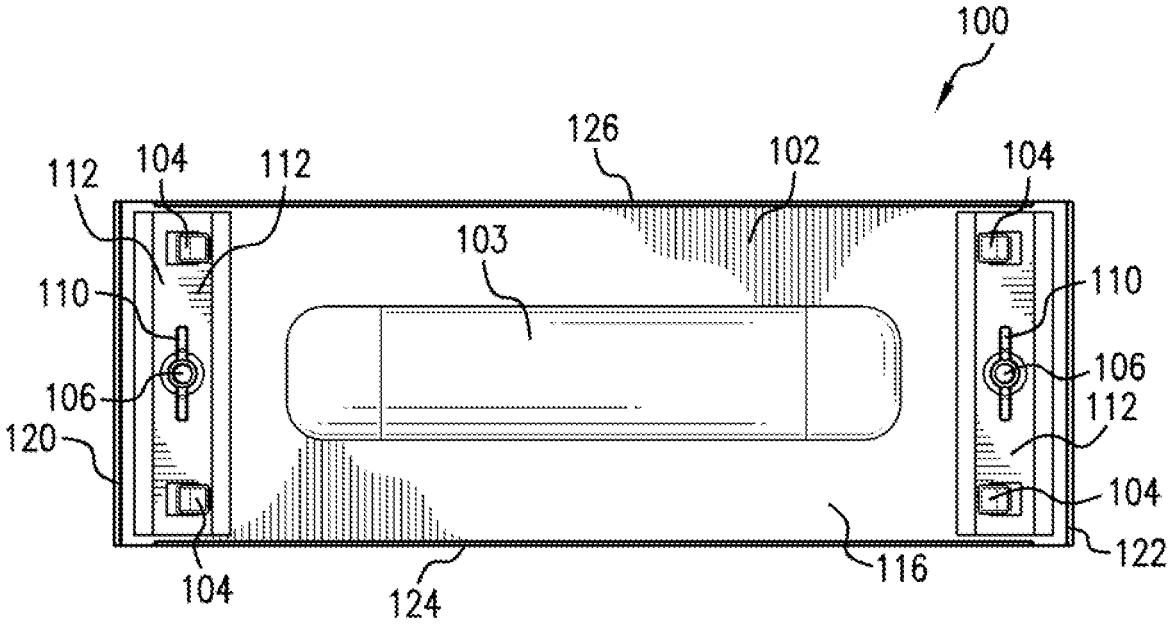
FIG. 4 is a top view of the sanding device of FIG. 1.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being connected to another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

With reference now to the drawings and in particular FIGS. 1-28, embodiments of sanding devices of the present disclosure, which are generally designated by reference numerals 100, 200, 300 and 400 will be described.

FIGS. 1-7 depict various views of an embodiment of a sanding device 100. The sanding device 100 can, for example, be used as a hand sanding device. The sanding device 100 generally includes a base 102, a handle 103, a plurality of protrusions 104 that extend from the base 102, a plurality of fasteners 106, 108, 110, clamping mechanisms 112 and springs 114.

The base 102, which has a first surface 116 and a second surface 118 that is mirror opposite the first surface 116, is delimited at a first sidewall 120, a second sidewall 122 that is spaced from the first sidewall 120, a third sidewall 124 that extends between the first sidewall 120 and the second sidewall 122, and a fourth sidewall 126 that is spaced from the third sidewall 124 and extends between the first sidewall 120 and the second sidewall 122. The first sidewall 120 and the second sidewall 122 are shorter than the third sidewall 124 and the fourth sidewall 126 such that together, the sidewalls 120, 122, 124, 126 form a rectangular shape. It is noted that while the base 102 is depicted as having a rectangular shape that the base 102 should not be limited to a rectangular shape and can be any shape such as a square, trapezoid, oval, etc.

The handle 103 can extend directly from the base 102 such that the base 102 and the handle 103 are formed together. Alternatively, the handle 103 can be fixed to the base 102 by a fastener (e.g., screw), an adhesive or other material or a combination thereof.

As shown, a first one of the protrusions 104 and a second one of the protrusions 104 are spaced from each other and are each integral to and extend directly from the first surface 116 near the first sidewall 120, and a third one of the protrusions 104 and a fourth one of the protrusions 104 are spaced from each other and are each integral to and extend directly from the first surface 116 near the second sidewall 122. The first and the second protrusions 104 and the third and the fourth protrusions 104, respectively, extend parallel to each other.

Figure 5:
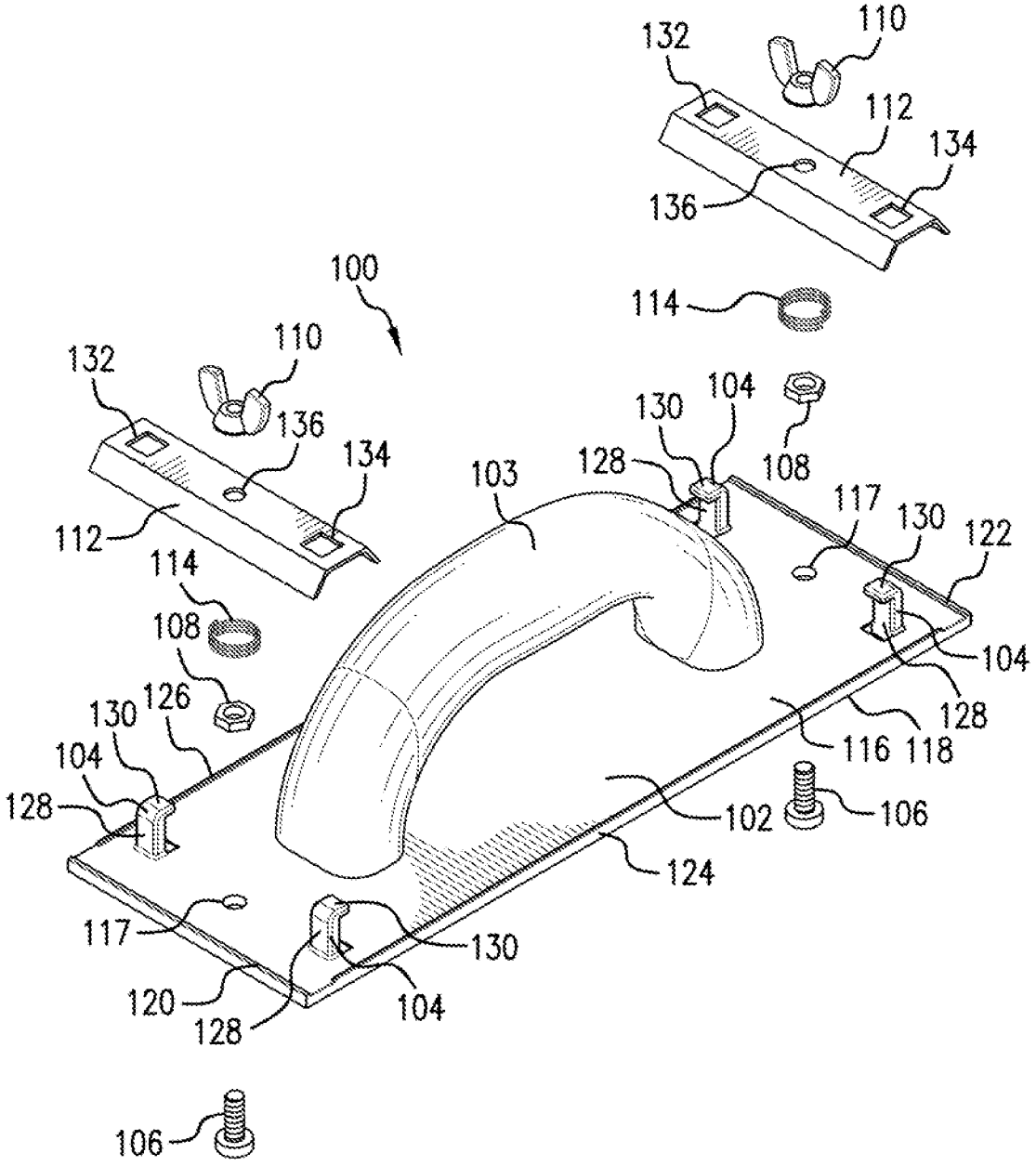
FIG. 5 is a first exploded view of the sanding device of FIG. 1.
Figure 6:
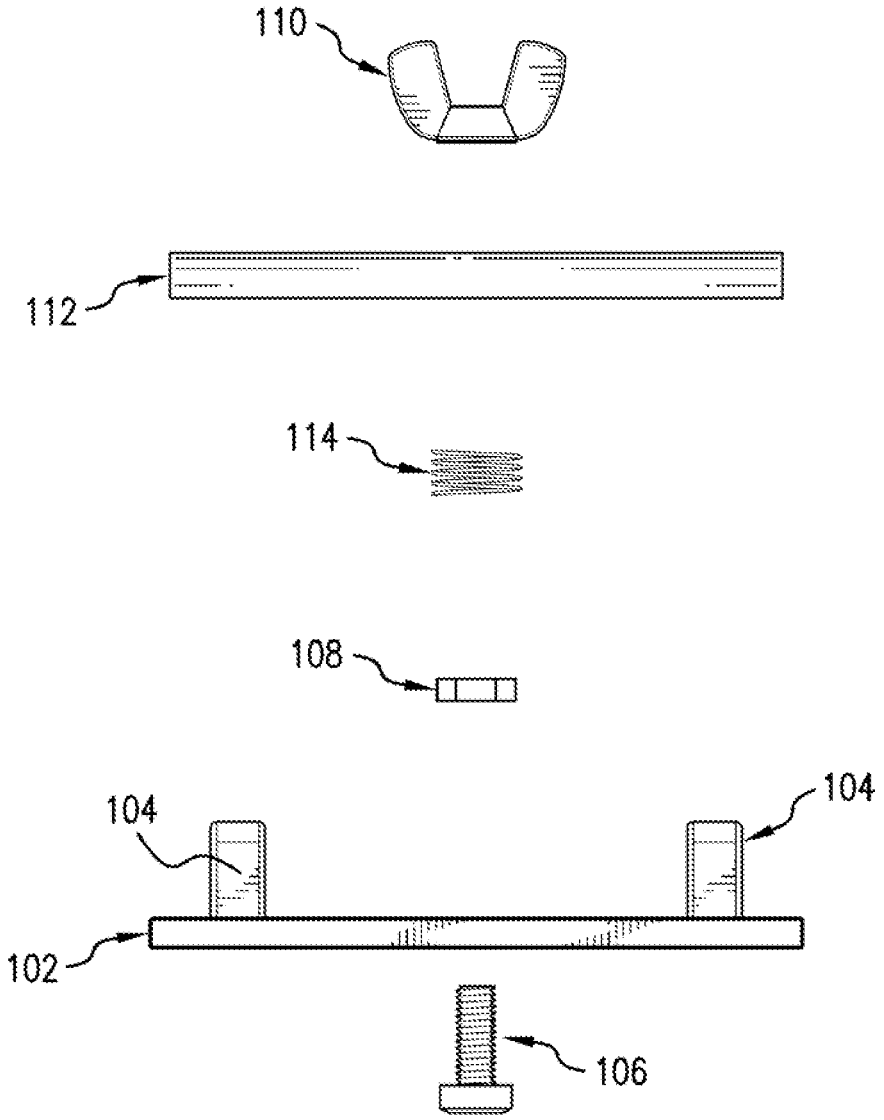
FIG. 6 is a second exploded view of the sanding device of FIG. 1.

The protrusions 104, can, for example, be L-shaped such that each protrusion 104 includes a first leg 128 that extends from the base 102, substantially perpendicular to the base 102 and a second leg 130 that extend substantially parallel to the base 102 (see FIG. 5). While the protrusions 104 are shown as having an L-shape, the protrusions 104 can be any shape that substantially prevents axial rotation of the clamping mechanisms 112. This is so because, for each one of the two clamping mechanisms 112, when the clamping mechanism 112 is selectively engaged with a pair of protrusions 104 by placing the clamping mechanism 112 over the first surface 116 of the base 102 with a pair of protrusions 104 respectively extending through openings (or holes) 132 and 134 of the clamping mechanism 112, the clamping mechanism 112 is at least substantially prevented from rotating axially over the first surface 116 by way of the contact that occurs between the protrusions 104 and the edge or rim of each one of the through openings 132 and 134.

However, since the size (or width) of the openings 132 and 134 of the clamping mechanism is greater than the size (or width) of the first leg 128 of each protrusion 104 (in order to allow the second legs 130, respectively, to fit through the openings 132 and 134), an insignificant amount movement and/or rotation may occur between each clamping mechanism 112 and first surface 116 of the base 102 when the clamping mechanisms 112 are engaged with the base 102 but not yet selectively clamped to the base 102. However, the minimal movement will not cause a gripping edge of the clamping mechanism 112 to be rotated (or twisted) away or at least any substantial movement, and therefore lose grip, of a sheet of sandpaper that has been inserted in between the base 102 and the clamping mechanism 112 just prior to clamping the sandpaper in place with the clamping mechanism 112 (e.g., by tightening the fastener 110 over the clamping mechanism 112 with the sheet of sandpaper being inserted between the base 102 and the clamping mechanism 112).

This feature of the sanding device 100 is beneficial because it prevents the clamping mechanism 112 from losing contact (or grip) with a sheet of sandpaper that has been inserted (to be clamped) between the base 102 and the clamping mechanism 112 due to any rotation that could otherwise occur in the clamping mechanism 112 while the user fetches the fastener 110 and selectively couples (e.g., screws) the fastener 110 on the fastener 106 in order to clamp the mechanism 112 in place. Therefore, a user need not utilize one of the user's hands to hold the clamping mechanism 112 in place while reaching out with the other hand to grasp the fastener 110 and tightening the clamping mechanism 112 in place because the clamping mechanism 112 will not rotate or twist out of place even when not being pressed down by the user's hand.

Figure 14:
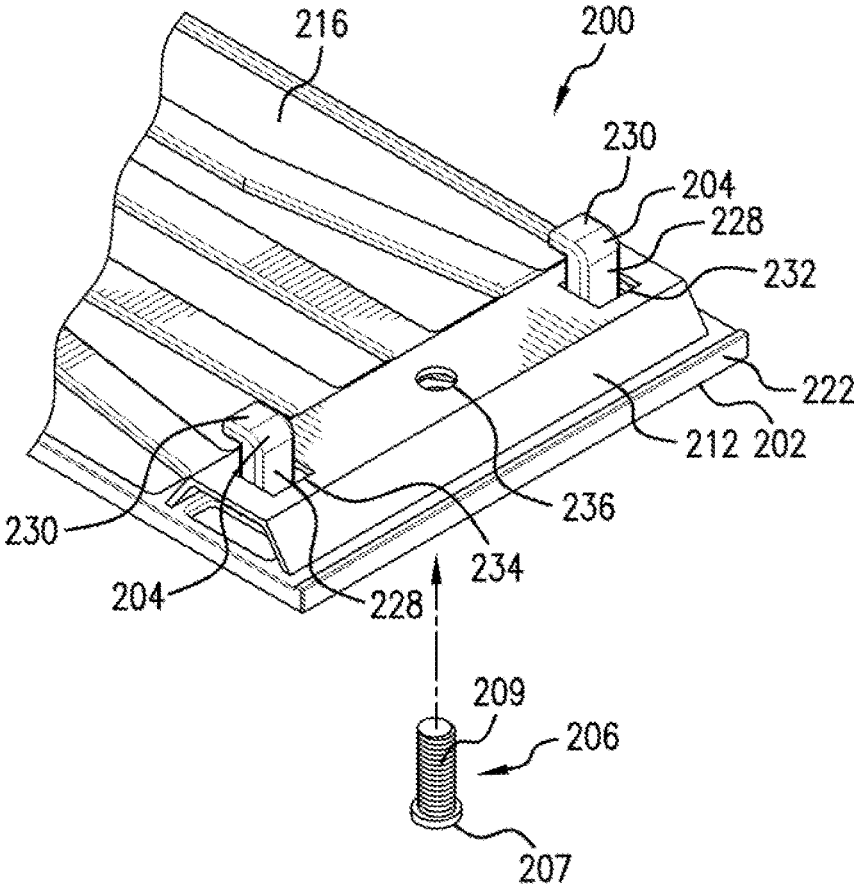

In addition, the protrusions 104 are configured to prevent the clamping mechanism from becoming disengaged from the sanding device 100 when the fasteners 106, 108, 110 are not in place to secure the clamping mechanisms 112 to the base 102, unless desired. This is so because, when the clamping mechanism 112 has been engaged with the base 102 (as shown in FIG. 14), and has been slid slightly forward as illustrated by the two directional arrows illustrated in FIG. 14, the openings 132 and 134 would be misaligned with the second leg 130 of their respective protrusions 104. The spring 114 would push the clamping mechanism 112 upwardly, but as a result of this misalignment, the top portion of the body of the clamping mechanism 112 would come into contact (or be pressed against) the second leg 130 of each of the two protrusions 104, thereby, preventing the clamping mechanism 112 from being lifted upwardly beyond the height of the respective second legs 130 thereof, unless desired.

Figure 7:
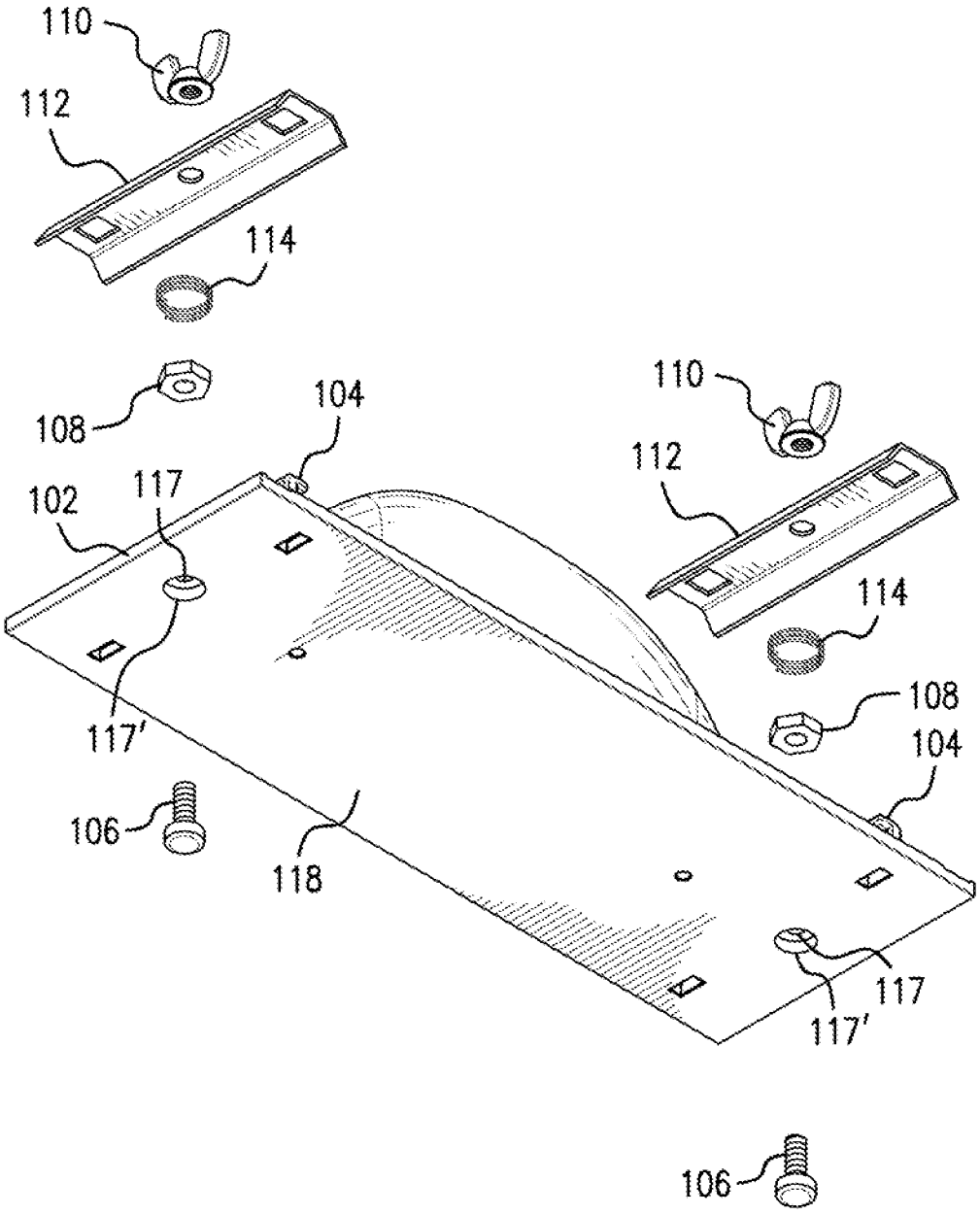
FIG. 7 is a bottom perspective view of the sanding device of FIG. 1 in an unassembled state.

This configuration is advantageous because the spring 114 ensures that each clamping mechanism 112 remains lifted by a distance from the base 102 in order to allow a sheet of sandpaper to be loaded in or removed from the space between the base 102 and the clamping mechanism 112 while ensuring that the clamping mechanism 112 does not separate from the base or rotate out of position while the user is loading or unloading the sandpaper, or reaching to grasp the connector 110 in order to clamp the sandpaper in place with the clamping mechanism 112. In other words, a user does not have to manually lift the clamping mechanism 112 up from the base 102 in order to create a gap to insert a sheet of sandpaper under the clamping mechanism 112, and the user does not need to manually press down on the clamping mechanism 112 after having inserted the sandpaper sheet in place to ensure that the sandpaper does not slide out of position while the user reaches for the connector 110 in order to tighten it on the connector 106 with the clamping mechanism 112 fixed in place therebetween. This configuration facilitates loading and unloading of sandpaper from the sanding device 100 and reduces the time needed to load and unload sandpaper from the device, and, in turn, can increase efficiency and simplify assembly time and in turn reduce labor costs associated with utilizing the device 100. As can be seen in FIG. 7, recessed openings 117 extend from the second surface 118 toward the first surface 116 between the first and second protrusions 104 near the first sidewall 120 and between the third and fourth protrusions 104, near the second sidewall 122. Reference numeral 117' in FIG. 7 indicates the recess in each of the openings 117. Each of the recessed openings 117 is configured for one of the first fasteners 106 to extend therethrough and to receive a head of the first fasteners 106. Each one of the first fasteners 106 may be substantially the same as a first fastener 206 illustrated in FIG. 14. Therefore, the head of each one of the first fasteners 106 may be substantially the same as a head 207 of the fasteners 206, as illustrated in FIG. 14. Each recess 117' is configured to fit inside the head of each fastener 106. The recessed openings 117 act as a stop so that the fasteners 106 do not extend entirely through the openings 117 and ensure that the fasteners 106 do not protrude from the second surface 118 and are instead substantially flush or flush with respect to the second surface 118. In other words, the entire head of each fastener 106 fits inside of respective recess 117'.

The first fastener 106 can each include threading 109 (see e.g., FIG. 1) such that after extending the fastener 106 through the protrusion 117, a mating threaded second fastener (e.g., a nut) 108 can interact therewith to secure the first fastener 106 in place with respect to the base 102. The first and second fasteners 106, 108 are configured to receive a spring 114 (e.g., a compression spring) that can extend over and at least partially encompass the fasteners 106, 108.

With reference to FIG. 5, each clamping mechanism 112 includes a first opening 132 through which one of the protrusions 104 can extend in an assembled state, a second opening 134 through which another one of the protrusions 104 can extend in an assembled state and a third opening 136 that is arranged between the first opening 132 and the second opening 134 through which the first fastener 106 can extend in an assembled state.

The third fastener 110, such as a wing nut (or butterfly nut), can interact with the first fastener 106 to releasably fix the clamping mechanism 112 in contact with the base 102 and aid prevent axial rotation of the clamping mechanism 112 and in turn prevent disengagement of sand paper from a desired fixed position in relation to the first surface 116 of the base 102 of the sander 100. The interaction of the protrusions 104 with the clamping mechanism 112 prevents the clamping mechanism 112 from rotating off axis when the fastener 110 is loosened.

Each one of the base 102, the handle 103, the protrusions 104, the fasteners 106, 108, 110 and the clamping mechanisms 112 may be made of an elastomeric material (e.g., a plastic material), a metal, wood, or a combination thereof. The springs 114 are preferably made of a metal, but can also be made of plastic material or the like.

Examples of the elastomeric material include, without limitation, polyvinyl chloride (PVC), polycarbonate (PC), acrylonitrile butadiene styrene (ABS), polydicyclopentadiene (pDCPD), acetal, acrylic, nylon, high-density polyethylene (HDPE), etc., or blends thereof. Examples of the metal material include, without limitation, steel, nickel, zinc, copper, tin, aluminum, titanium, etc., or alloys thereof.

FIGS. 8-16 depict various views of a sanding device 200. The sanding device 200 generally includes a base 202, a plurality of protrusions 204 that extend from the base 202, a plurality of fasteners 206, 208, 210, (e.g., first fasteners 206, second fasteners 208 and third fasteners 210), clamping mechanisms 212, springs 214, a plurality of arms 240 and a receiving attachment member 250 that is hingedly connected to the arms 240. The receiving attachment member 250 is configured to be selectively connected to an extension pole in order to enable a user to sand with the apparatus 200 areas that the user could not otherwise reach.

The sanding device 200 may be substantially similar to or the same as the sanding device 100 except that the sanding device 200 includes the arms 240 and the receiving attachment member 250 instead of the handle 103 of the sanding device 100. For brevity purposes, components or elements of the sanding device 200 that are not described in detail below may be assumed to be the same as or similar to corresponding components/elements described elsewhere in this specification.

The base 202, which has a first surface 216 and a second surface 218 that is mirror opposite the first surface 216, is delimited at a first sidewall 220, a second sidewall 222 that is spaced from the first sidewall 220, a third sidewall 224 that extends between the first sidewall 220 and the second sidewall 222 and a fourth sidewall 226 that is spaced from the third sidewall 224 and extends between the first sidewall 220 and the second sidewall 222. The first sidewall 220 and the second sidewall 222 are shorter than the third sidewall 224 and the fourth sidewall 226 such that together, the sidewalls 220, 222, 224, 226 form a rectangular shape. It is noted that while the base 202 is depicted as having a rectangular shape that the base 202 should not be limited to a rectangular shape and can be any shape such as a square, trapezoid, oval, etc.

Figure 8:
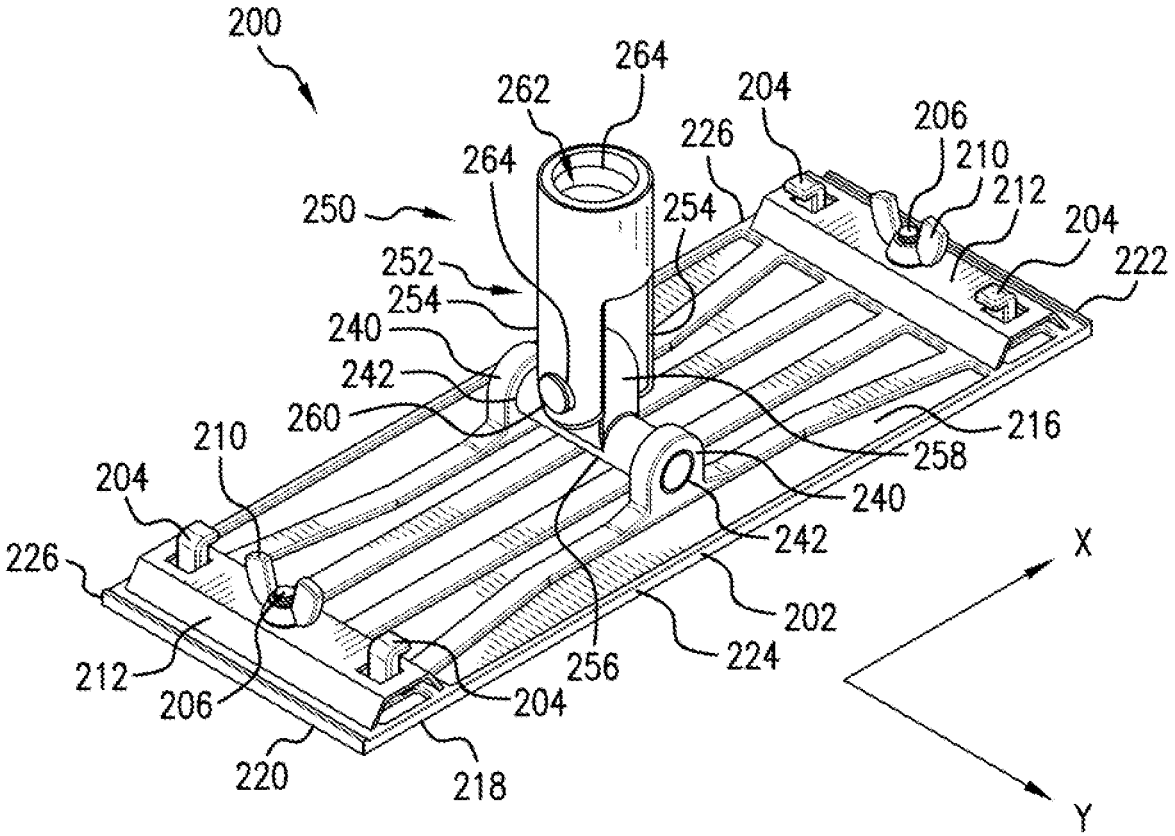
FIG. 8 is a perspective view of a sanding device according to according to another embodiment of the present disclosure.
Figure 10:
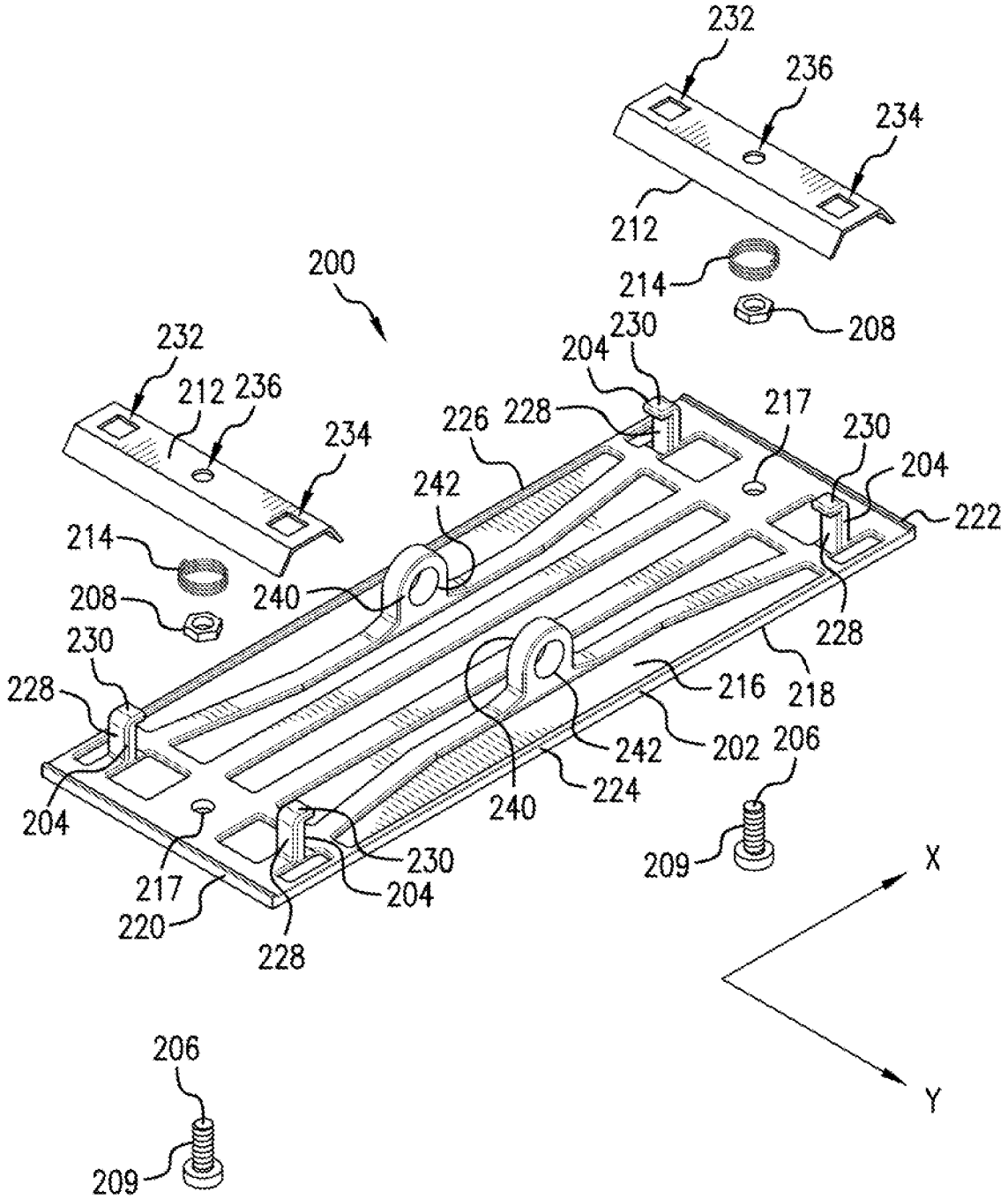
FIG. 10 is an exploded view of the sanding device of FIG. 8.

As shown, for example, in FIGS. 8 and 10, a first one of the protrusions 204 and a second one of the protrusions 204 are spaced from each other and each are integral to and extend directly from the first surface 216 near the first sidewall 220 and third one of the protrusions 204 and a fourth one of the protrusions 204 are spaced from each other and the first one of the protrusions 204 and the second one of the protrusions 204, and are each integral to and extend directly from the first surface 216 near the second sidewall 222.

The protrusions 204, can, for example, be L-shaped such that each protrusion 204 includes a first leg 228 that extends from the base 202, substantially perpendicular to the base 202 and a second leg 230 that extend substantially parallel to the base 202 (see FIG. 10). While the protrusions 204 are shown as having an L-shape, the protrusions 204 can be any shape that at least substantially prevents axial rotation of the clamping mechanisms 212 and in turn prevents the clamping mechanisms 312 from becoming disengaged from the sanding device 200 when the fasteners 206, 208, 210 are not in place to secure the clamping mechanisms 212 to the base 202, unless desired.

Figure 9:
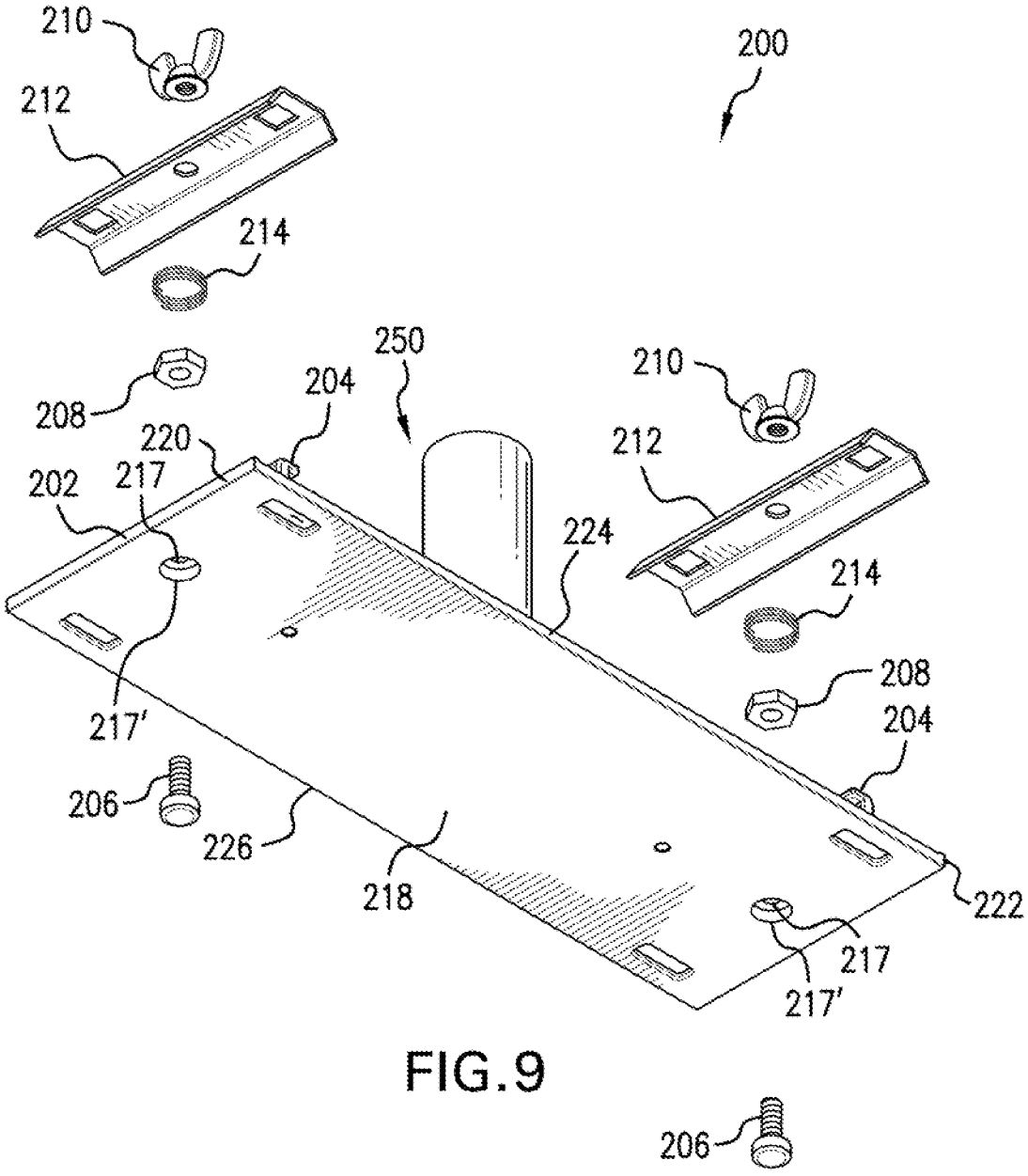
FIG. 9 is a bottom perspective view of a sanding device of FIG. 8.

As can be seen in FIG. 9, recessed openings 217 extend from the second surface 218 toward the first surface 216 between the first and second protrusions 204 near the first sidewall 220 and between the third and fourth protrusions 204, near the second sidewall 222. Reference numeral 217' in FIG. 9 indicates the recess in each of the openings 217. Each of the recessed openings 217 is configured for one of the first fasteners 206 to extend therethrough and to receive a head of the first fasteners 206, which is the same as the head 207 of the fastener 206 in FIG. 14. The recessed openings 217 act as a stop so that the fasteners 206 do not extend entirely through the openings 217 and ensure that the fasteners 206 do not protrude from the second surface 218 and are instead substantially flush or flush with respect to the second surface 218. In other words, the entire head 207 of each fastener 206 fits inside its respective recess 217-'.

The first fastener 206 can each include threading 209 such that after extending the fastener 206 through the protrusion 217, a mating threaded second fastener (e.g., a nut) 208 can interact therewith to secure the first fastener 206 in place with respect to the base 202. The first and second fasteners 206, 208 are configured to receive a spring 214 (e.g., a compression spring) that can extend over and at least partially encompass the fasteners 206, 208.

The clamping mechanism 212 includes a first opening 232 through which one of the protrusions 204 can extend in an assembled state, a second opening 234 through which another one of the protrusions 204 can extend in an assembled state and a third opening 236 that is arranged between the first opening 232 and the second opening 234 through which the first fastener 206 can extend in an assembled state.

The third fastener 210, such as a wing nut or the like, can interact with the first fastener 206 to releasably fix the clamping mechanism 212 in contact with the base 202, to at least substantially prevent axial rotation of the clamping mechanism 212, and in turn, to prevent disengagement of sand paper from a desired fixed position in relation to the first surface 216 of the base 202 of the sander 200.

The arms 240 are configured to hingedly connect the receiving attachment member 250 to the base 202. As illustrated in FIGS. 8 and 10, the arms 240 are spaced from one another, and may each extend from the first surface 216 of the base 202. The arms 240 may extend substantially parallel to one another, and may face one another. As illustrated in FIGS. 8 and 10, each arm 240 may have a through opening 242, and the through opening 242 may be circular.

As illustrated in FIGS. 8 and 10, the arms 240 may be disposed at substantially mid-length of the base 202, but this configuration is merely exemplary, and the arms 240 may also be disposed at other locations of the base 202.

Referring to FIG. 8, the receiving attachment member 250 may include a first body portion 252 with a pair of arms 254 extending from the first body portion 252 and being spaced apart from one another, a second body portion 256 with a centrally protruding part 258 (which extends in between the arms 254), and a shaft 260 which is connected to the centrally protruding part 258 and extends through matching openings 264 in the arms 254 in order to hingedly connect the first body portion 252 with the second body portion 256. FIG. 8 illustrates the opening 264 in only one of the arms 254, but it is understood that the other arm 254 has a matching opening 264 as well because the arms 254 are mirror opposites to one another.

Referring to FIG. 8, opposite end portions of the second body portion 256 of the receiving attachment member 250 are respectively inserted into the openings 242 of the arms 240. Therefore, the second body portion 256 serves to hingedly connect the receiving attachment member 250 to the base 202. Accordingly, the second body portion 256 of the receiving attachment member 250 enables the member 250 to be rotated relative to the base 202, and the shaft 260 enables the first body portion 252 of the receiving attachment member 250 to be rotated relative to the second body portion 240 thereof.

In the arrangement illustrated in FIG. 8, the second body portion 256 can be rotated about an axis Y, and the first body portion 252 can be rotated about an axis X. As illustrated in FIG. 8, the X and Y axes may cross one another, and may, for example, be perpendicular to one another.

As illustrated in FIG. 8, the first body portion 252 of the receiving attachment member 250 may have a cavity 262 for selectively connecting an extension pole to the receiving attachment member 250. The cavity 262 may have threads 264 for selectively engaging matching threads on a pole, but the present invention is not limited to this configuration. For example, the cavity 262 may also feature different connection mechanisms for enabling an extension rod to be selectively connected to the receiving attachment member 250 when desired.

Therefore, by connecting a pole to the receiving attachment member 250, the sanding device 200 may be utilized to sand surfaces that a user cannot readily reach unaided. In addition, the dual hinge configuration of the receiving attachment member 250 allows for three-dimensional articulation of the sanding device 200 while connected to the pole, which further increases the utility of the apparatus 200.

FIGS. 11-16 are various view of the assembly of the sanding device 200.

Figure 11:
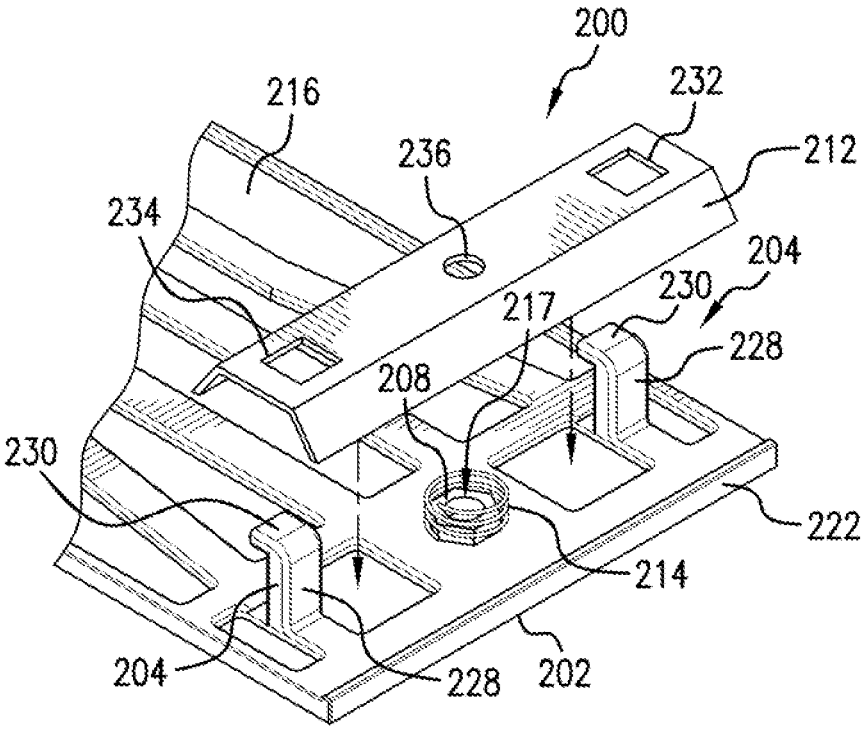
FIGS. 11-16 are partial perspective views illustrating a process of assembling the sanding device of FIG. 8 according to an embodiment of the present disclosure.

Referring to FIG. 11, as can be see, the second fastener 208 (e.g., a nut) is disposed over the opening 217 on the first side surface 216 of the base 202. The spring 214 is disposed over or around the second fastener 208. As indicated by the two directional arrows in FIG. 11, the clamping mechanism 212 is configured to be disposed on the first side surface 216 of the base 202, over the second fastener 208 and spring 214, by aligning the first and second openings 232 and 234, respectively, with the pair of protrusions 204 near the second sidewall 222 of the base 202.

Figure 12:
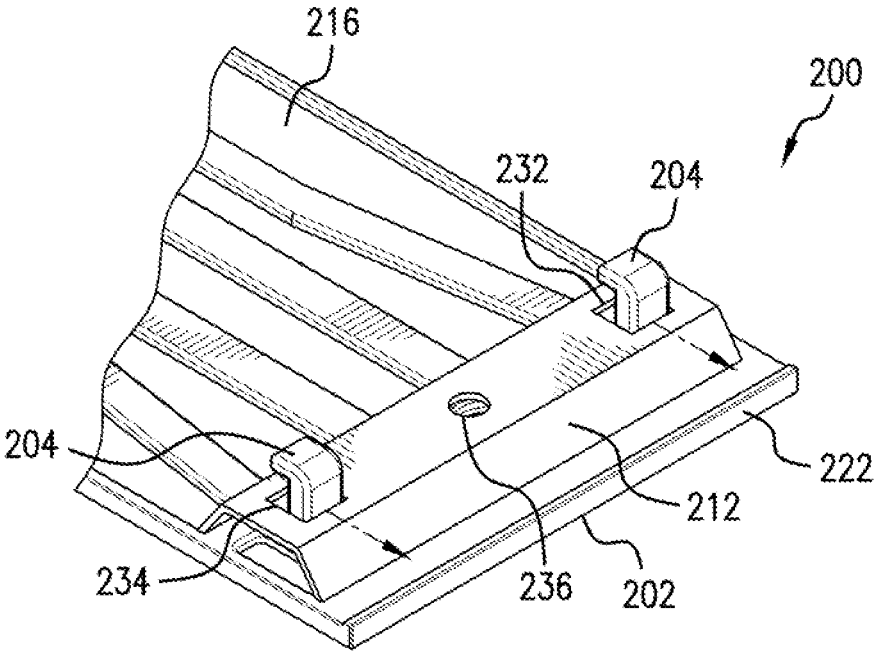

The resulting structure is illustrated in FIG. 12. In this state, the spring 214 is configured to be compressed. The clamping mechanism 212 may then be slid forward, as indicated by the two directional arrows in FIG. 12, in order to misalign the first and second openings 232 and 234 with the second legs 230 of their respective protrusions 204 as can be seen in FIG. 13.

Figure 13:
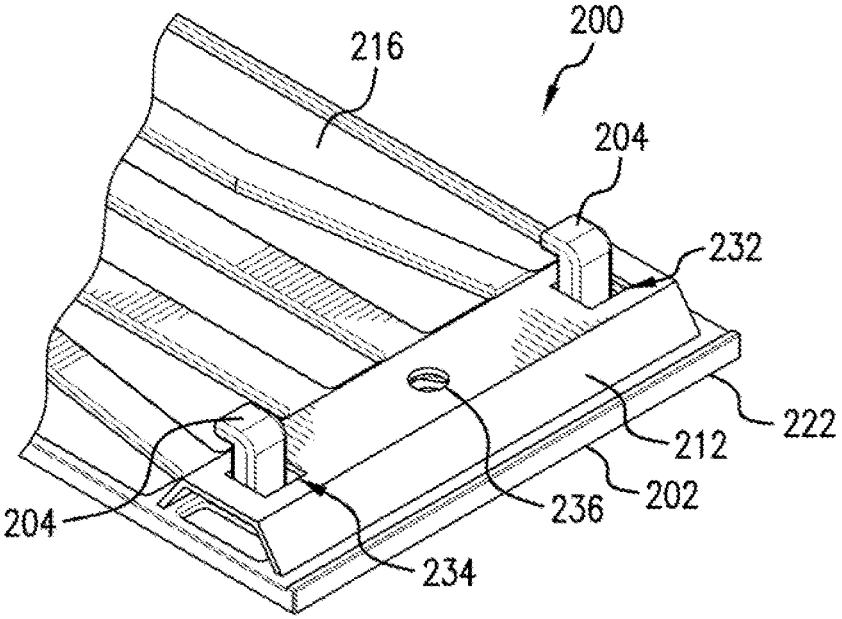

In the state illustrated in FIG. 13, the user may relieve the downwardly pressure applied to the clamping mechanism 212, although in FIG. 13 the clamping mechanism 212 is illustrated as being pressed down against the first surface 216 of the base 202. When downwardly pressure is relieved, the clamping mechanism 212 may be elevated over the first surface 216 of the base 202 due to the upwardly force exerted thereon by the spring 214 until a top portion of the clamping mechanism 212 comes in contact with the second legs 230 of the protrusions 204. The second legs 230 of the protrusions 204 would prevent the clamping mechanism 212 from being lifted upwardly any further, thereby ensuring that the clamping mechanism 212 is not disengaged from the protrusions 204, and that the clamping mechanism 212 is substantially prevented from rotating over the first surface 216 of the base 202.

A user can advantageously utilize the gap created by the elevation of the clamping mechanism 212 over the first surface 216 of the base 202 (due to the force applied by the spring 214), to load or unload a sheet of sandpaper in between the first surface 216 of the base 202 and the clamping mechanism 212. The sheet of sandpaper can then be orientated as needed.

Figure 15:
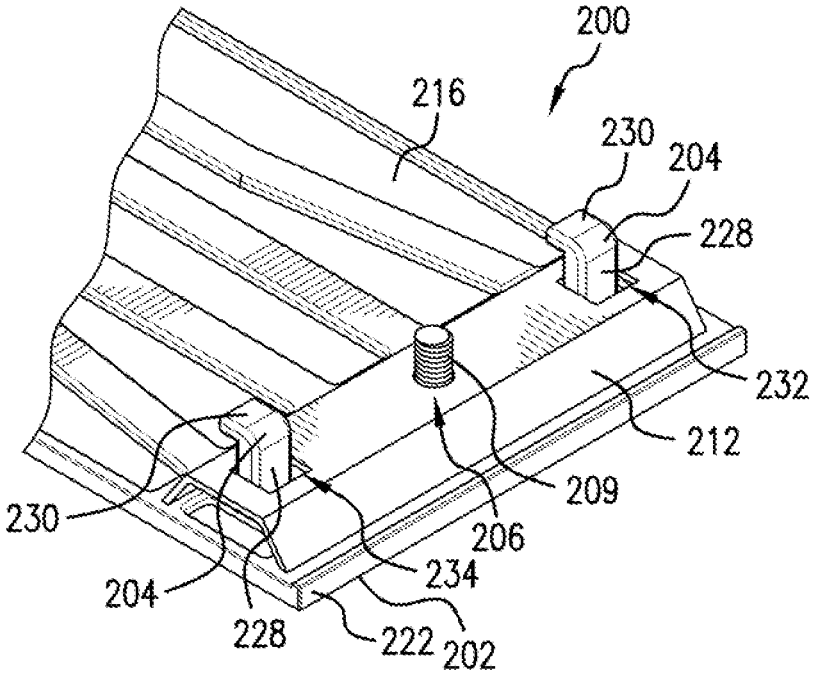

The first fastener 206 (e.g., screw 206) may then be inserted into the opening 217 from the second surface 218 of the base 202, as illustrated by the directional arrow in FIG. 14. As shown, the head 207 of the screw 206 is configured to fit entirely into the recess 217' surrounding the opening 217 at the second surface 218. The fastener 206 and/or the fastener 208 may be rotated against one another during the upwardly insertion process such that the threaded portion 219 of the first fastener 206 can be threadably engaged with the second fastener 208 until the two fasteners are tightly (or securely) connected to one another. The resulting structure is illustrated in FIG. 15. In this state, the second fastener 208 securely connects the first fastener 206 with the base 202.

Figure 16:
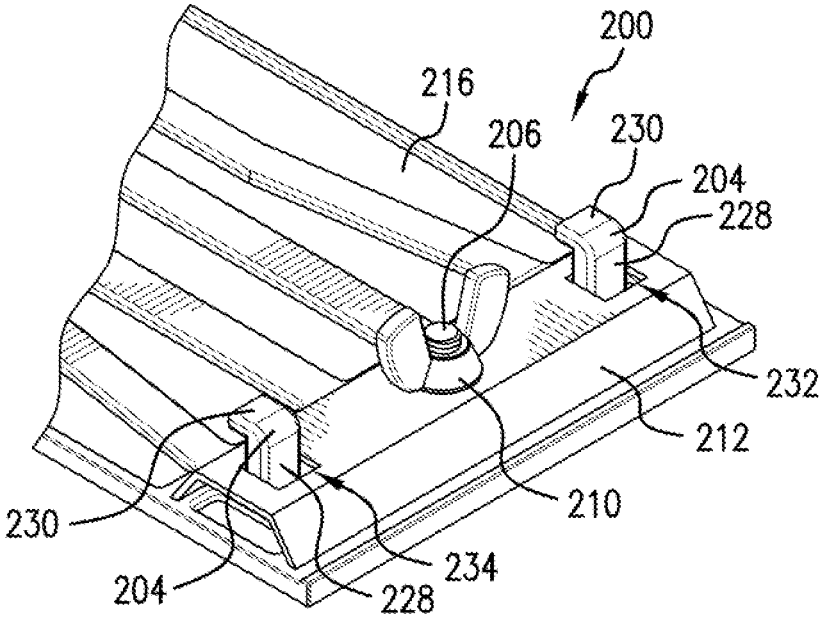

Referring to FIG. 16, the third fastener 210 (e.g., a butterfly nut) can be threadably engaged with the first fastener 206 until the third fastener 210 is tightened over the clamping mechanism 212 to a degree that is sufficient to ensure that the sandpaper will not become disconnected from under the clamping mechanism 212 when the apparatus 200 is in use.

While in the example above it illustrated that the first fastener 206 is inserted upwardly to be connected with the second fastener 208 after the clamping mechanism 212 has been engaged with the protrusions 204, the present invention is not limited to this method of assembly. For example, the first fastener 206 may also be inserted upwardly to be selectively connected to the second fastener 208 prior to connecting the clamping mechanism 212 with the protrusions 204 (e.g., in the state illustrated on FIG. 11.).

When a user desires to remove a sheet of sandpaper from the sanding device 200, the user would selectively disconnect (e.g., unthread) the third fastener 210 from the first fastener 206. When the third fastener 210 is disconnected from the first fastener 206, the clamping mechanism 212 would be lifted upwardly from the base 202 due to the force of the spring 214 acting thereon, thereby facilitating the sandpaper removal process. Advantageously, the protrusions 204 would prevent the clamping mechanism 212 from being disconnected from (or disengaged with) the protrusions 204 in this state, and also prevent or at least substantially prevent the clamping mechanism 212 from being rotated such that a user would not need to use a hand to press down on the clamping mechanism 212 to ensure that it does not fall off the base 202 when the third fastener 210 is disconnected from the first fastener 206.

The description above applies to a method of assembling the device 100 as well.

However, for the device 200, a user can selectively connect an extension pole to the receiving attachment member 250 for example, by threading an end of the extension pole to the cavity 262 of the first body portion 252 of the attachment member 250.

Figure 17:
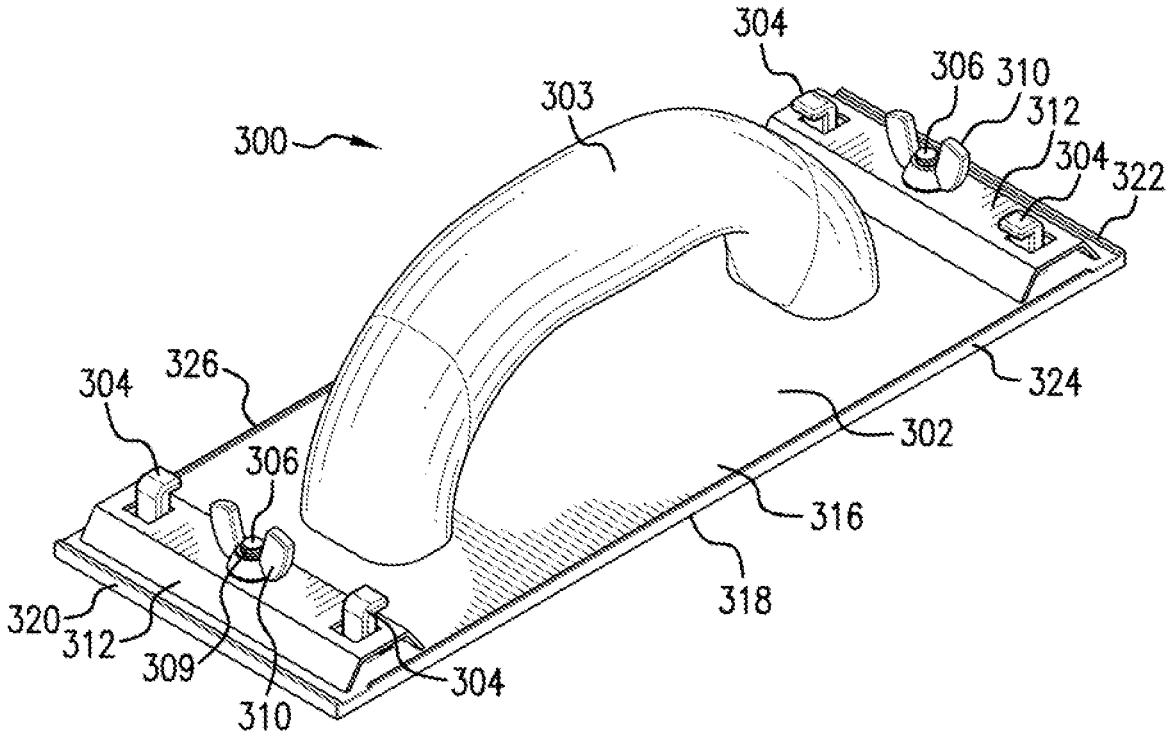
FIG. 17 is a perspective view of a sanding device according to according to another embodiment of the present disclosure.
Figure 18:
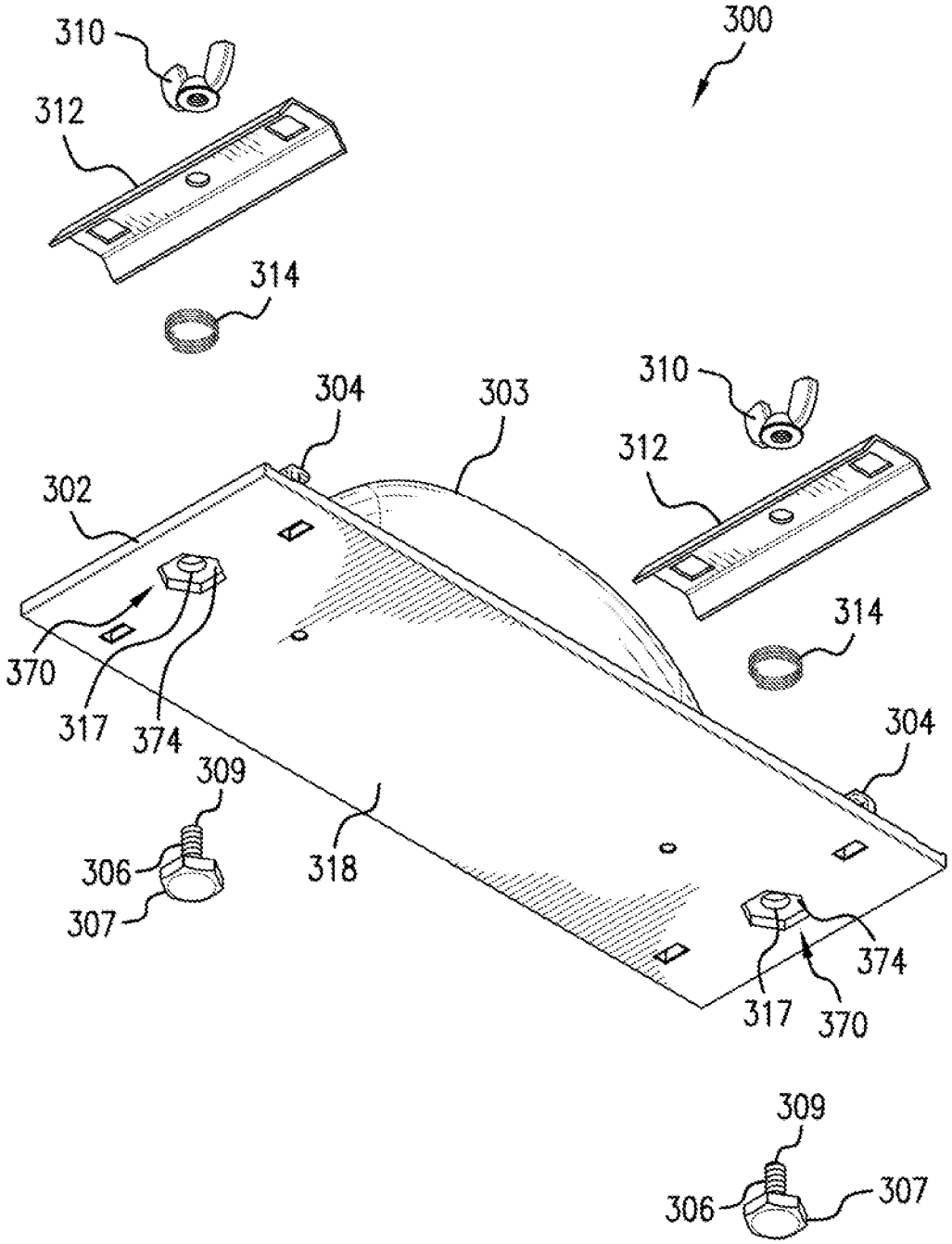
FIG. 18 is a bottom perspective view of the sanding device of FIG. 17.
Figure 19:
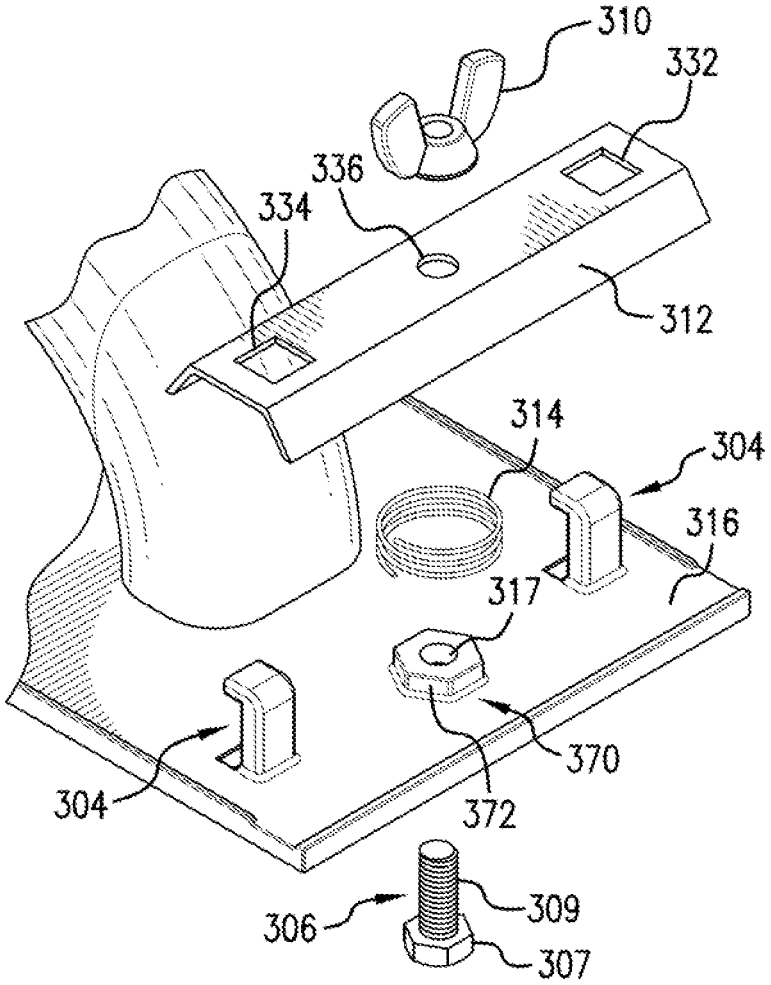
FIG. 19 is a partial exploded view of the sanding device of FIG. 17.

FIGS. 17-19 depict various views of an embodiment of a sanding device 300. The sanding device 300 can, for example, be used as a hand sanding device. The sanding device 300 generally includes a base 302, a handle 303, a plurality of protrusions 304 that extend from the base 302, a plurality of projections 370 with respective openings 317, a plurality of fasteners 306, 310, including first fasteners 306 and second fasteners 310, clamping mechanisms 312 and springs 314.

Referring to FIGS. 17-19, the base 302, which has a first surface 316 and a second surface 318 that is mirror opposite the first surface 316, is delimited at a first sidewall 320, a second sidewall 322 that is spaced from the first sidewall 320, a third sidewall 324 that extends between the first sidewall 320 and the second sidewall 322 and a fourth sidewall 326 that is spaced from the third sidewall 324 and extends between the first sidewall 320 and the second sidewall 322. The first sidewall 320 and the second sidewall 322 are shorter than the third sidewall 324 and the fourth sidewall 326 such that together, the sidewalls 320, 322, 324, 326 form a rectangular shape. It is noted that while the base 302 is depicted as having a rectangular shape that the base 302 should not be limited to a rectangular shape and can be any shape such as a square, trapezoid, oval, etc.

The handle 303 can extend directly from the base 302 such that the base 302 and the handle 303 are formed together. Alternatively, the handle 303 can be fixed to the base 302 by a fastener (e.g., screw), an adhesive or other material or a combination thereof.

As shown, a first one of the protrusions 304 and a second one of the protrusions 304 are spaced from each other and are each integral to and extend directly from the first surface 316 near the first sidewall 320 and a third one of the protrusions 304 and a fourth one of the protrusions 304 are spaced from each other and the first one of the protrusions 304 and the second one of the protrusions 304, and are each integral to and extend directly from the first surface 316 near the second sidewall 322. The first and the second protrusions 304 and the third and the fourth protrusions 304, respectively, extend parallel to each other.

The protrusions 304, can, for example, be L-shaped such that each protrusion 304 includes a first leg 328 that extends from the base 302, substantially perpendicular to the base 302 and a second leg 330 that extend substantially parallel to the base 302. While the protrusions 304 are shown as having an L-shape, as will be described in more detail below, the protrusions 304 can be any shape that substantially prevents axial rotation of the clamping mechanisms 312 and prevents the clamping mechanisms 312 from becoming disengaged from the sanding device 300 when the fasteners 306, 310 are not in place to secure the clamping mechanisms 312 to the base 302, unless desired.

As depicted in FIGS. 18-19, a pair of recessed openings 370 are formed on the base 302. Referring to FIGS. 18-19, each one of the recessed openings 370 has a shape and size that can fit inside an entire head 307 of one of the first fasteners 306. Importantly, the shape and size of each protrusion 370 prevents its corresponding first fastener 306 from being rotated once that the head 307 of the fastener 306 is inserted inside of the projection 370 due to the facets of the protrusion 307 and the facets of the head 307 of the fastener 306.

Referring to FIGS. 18-19, an opening 307 extends through each projection 370. The description below may refer to one of the projections 370, but it is understood that the same description may apply to both projections 370.

Referring to FIG. 19, an outer surface 372 of the projection 370 is connected to and extends upwardly from the first surface 316 (e.g., a top surface) of the base 302. Referring to FIG. 18, a recessed opening or socket 374 of the projection 370 is connected to the second surface 318 (e.g., a bottom surface) of the base 302, and extends away from the second surface 318 in a direction toward the first surface 316 (and can even extend beyond the first surface 318, as can be gleaned with reference to FIG. 18-19).

Referring to FIGS. 18-19, the opening 307 extends from the recessed opening or socket 374 to the outer surface 372 of the projection 370, enabling the threaded portion 309 of the first fastener 306 to pass through the base 302, as can be gleaned with reference to FIGS. 17-19.

As indicated above, a depth of an interior space defined by the recessed opening or socket 374 of the projection 370 is sufficient to accommodate the entire head 307 of the fastener 306 inside said interior space such that the head 307 of the fastener 306 does not protrude downwardly from underneath the surface 318, thereby, avoiding interference with the sandpaper sheet below.

As illustrated in FIG. 18, the recessed opening or socket 374 of the projection 370 defines a chamber for accommodating the head 307 of the fastener 306, and the chamber includes a plurality of facets (e.g., six facets, as illustrated in FIG. 18), which prevents the fastener 306 from being rotated when the hexagonal head 307 of the fastener 306 is inserted in the recessed opening or socket 374 of the projection 370. This configuration eliminates the need to use another fastener to secure the fastener 306 to the base 302 and to prevent the fastener 306 from being rotated together with the fastener 310 while the fastener 310 is being coupled to (or threadably engaged with) the fastener. In addition, the configuration of the sander 300 also reduces the number of parts and assembly time of the device.

The projection 370, or more precisely, the space defined by the recessed opening or socket 374 of the projection 370 has a hexagonal shape configured to accommodate the hexagonal head 307 of the first fastener 306 inside, which advantageously prevents the head 307 from being rotated. However, the present invention is not limited to this configuration, and the space (or chamber) defined by the recessed opening or socket 374 of the projection 370 and the head of a fastener 306 can both be configured to have matching shapes that allow the entire head of the fastener to be accommodated inside of the projection 370 while preventing the fastener from being rotated while the head thereof is inserted inside of the recessed opening. These matching shapes may be, for example, octagonal, square, ovoid, elliptical, etc. In other words, the chamber defined by the recessed opening or socket 374 may include a plurality of flat sidewalls (e.g., the facets described above), an elliptical sidewall, an ovoid sidewall, or a combination of flat and curved sidewalls.

The projection 370 may be formed, for example, by a stamping process (and punching or drilling the opening 317), by forming a hole in the base 302 and then separately attaching (e.g., adhering) the projection 370 to the base 302 over the hole, by an injection molding or casting process that would form the projection 370 simultaneously with the base 302, etc. In other words, the projection 370 may be formed integral with the base 302. Each opening 317 is configured for one of the first fasteners 306 to extend therethrough.

The first fastener 306 and the projection 370 are configured to receive a spring 314 (e.g., a compression spring) that can extend over and at least partially encompass the first fastener 206 and the projection 370, as illustrated in FIG. 19.

The clamping mechanism 312 includes a first opening 332 through which one of the protrusions 304 can extend in an assembled state, a second opening 334 through which another one of the protrusions 304 can extend in an assembled state and a third opening 336 that is arranged between the first opening 332 and the second opening 334 through which the first fastener 306 can extend in an assembled state.

The second fastener 310, such as a wing nut (or butterfly nut or the like), can interact with the first fastener 306 to releasably fix the clamping mechanism 312 in contact with the base 302 and substantially prevent axial rotation of the clamping mechanism 312 and in turn aid to prevent disengagement of sand paper from a desired fixed position in relation to the base 302 of the sander 300. The interaction of the protrusions 304 with the clamping mechanism 312 prevents the clamping mechanism 312 from rotating off axis when the fastener 310 is loosened.

Figure 20:
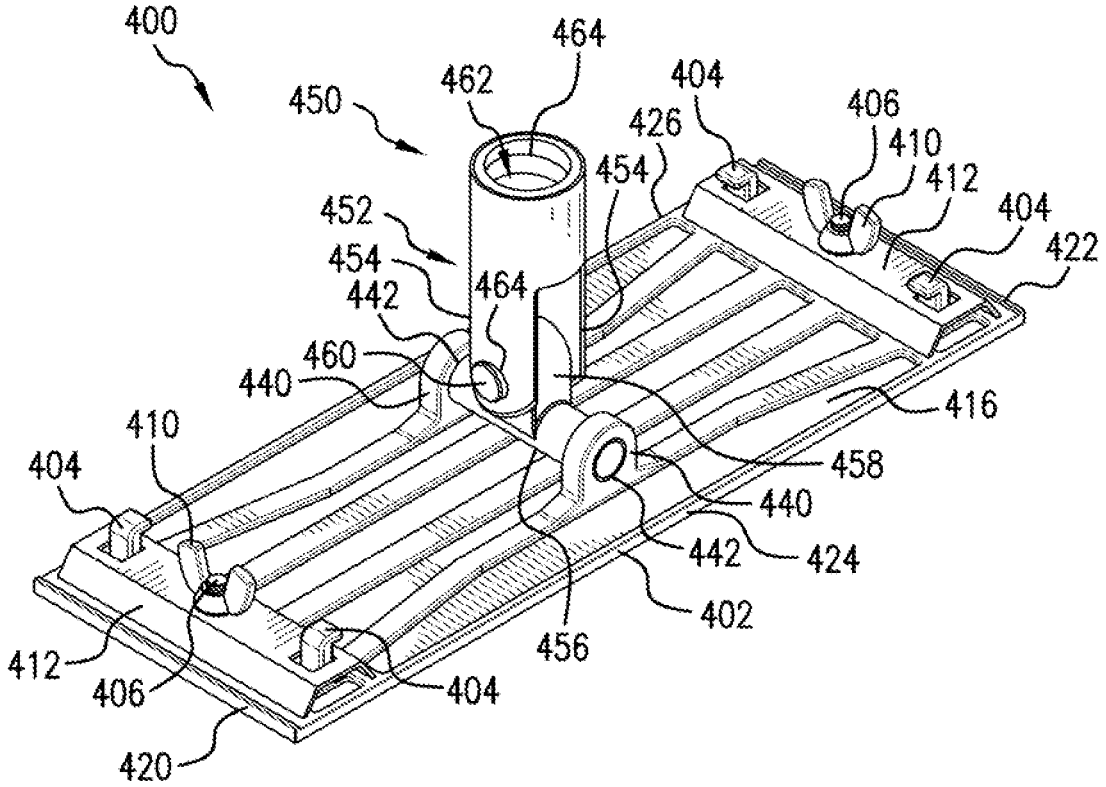
FIG. 20 is a perspective view of a sanding device according to according to another embodiment of the present disclosure.
Figure 21:
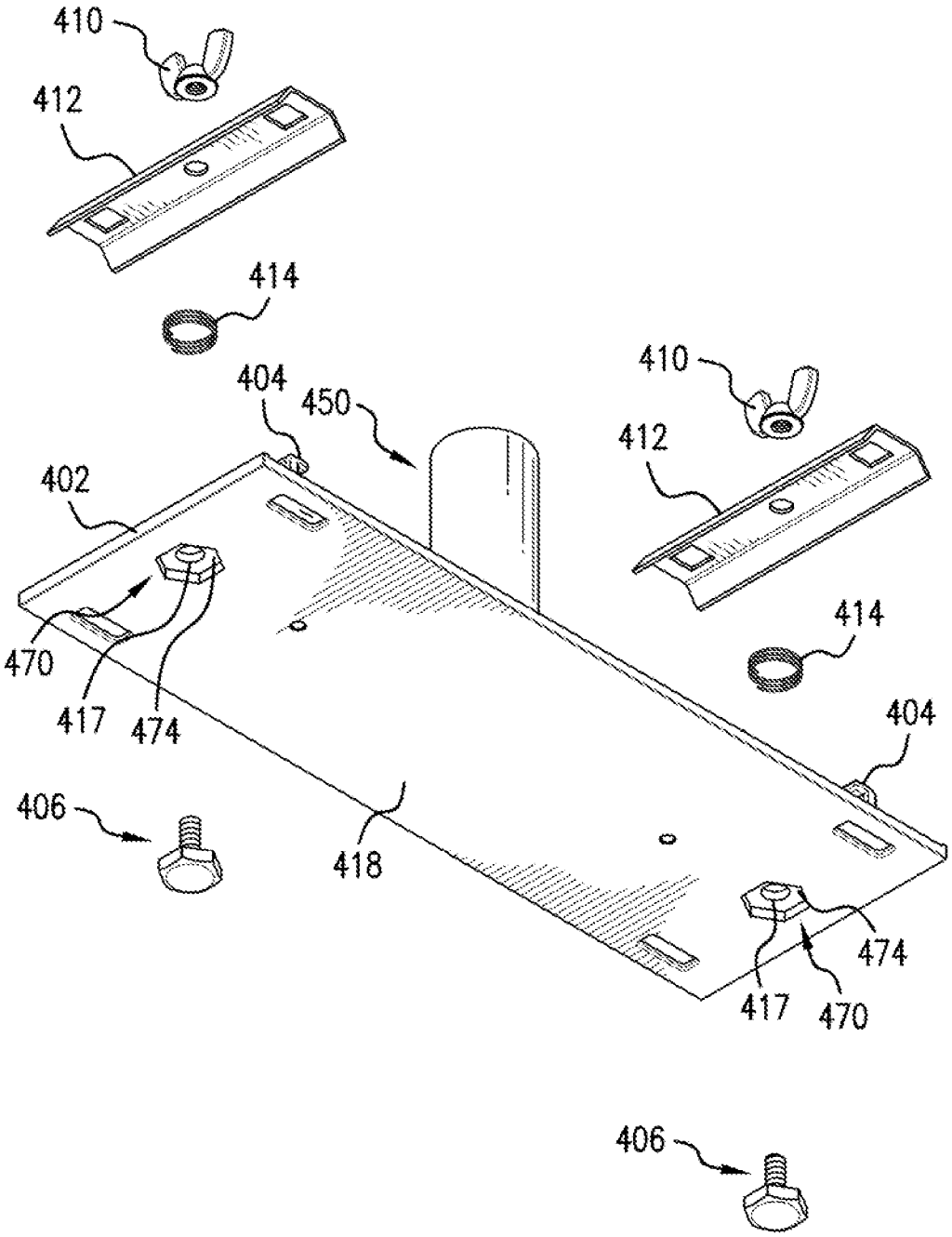
FIG. 21 is a bottom exploded perspective view of the sanding device of FIG. 20.
Figure 22:
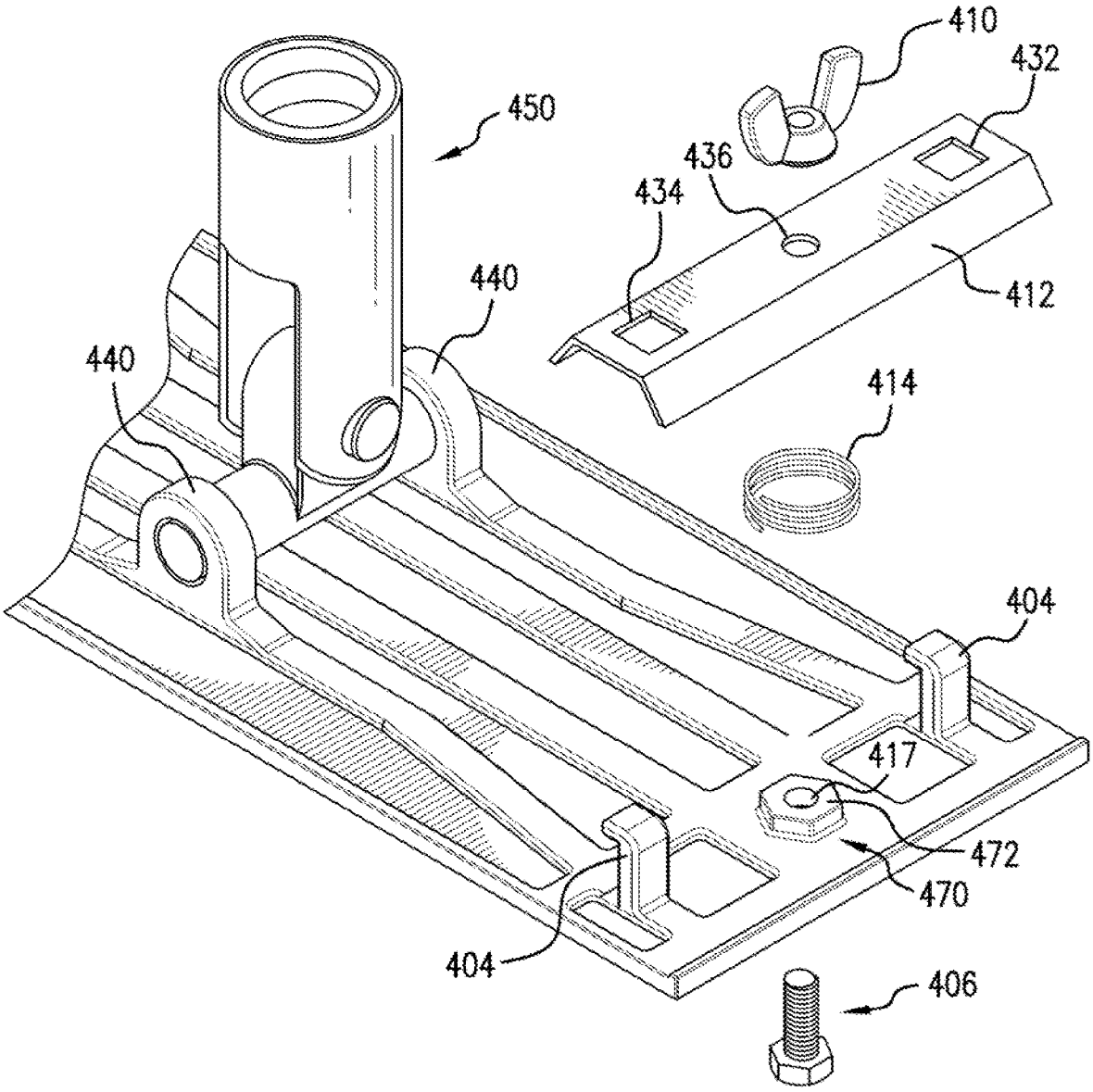
FIG. 22 is a top partial exploded view of the sanding device of FIG. 20.

FIGS. 20-22 depict various view of another embodiment of a sanding device 400. The sanding device 400 can, for example, be used in conjunction with a pole (not shown) to form a pole sanding device. The sanding device 400, generally includes base 402, a plurality of protrusions 404 that extend from the base 402, a plurality of projections 470, a plurality of fasteners 406, 410, including first fasteners 406 and second fasteners 410, clamping mechanisms 412, springs 414, a plurality of arms 440 and a receiving attachment member 450 that is hingedly connected to the arms 440. The receiving attachment member 450 is configured to be selectively connected to an extension pole in order to enable a user to reach areas that the user could not otherwise reach.

The sanding device 400 has a configuration that is similar to or the same as the sanding device 300 except that the sanding device 400 includes the arms 440 and the attachment member 450 instead of the handle 303 of the sanding device 300. For brevity purposes, only the differences between the sanding devices 300 and 400 may be described below. Elements or components of the sanding device 400 that are not described in detail below may be assumed to be the same as or similar to corresponding elements described elsewhere in this specification.

The arms 440 are configured to hingedly connect the receiving attachment member 450 to the base 402. As illustrated in FIGS. 20 and 22, the arms 440 are spaced from one another and extend from the first surface 416 of the base 402 substantially parallel to one another with a through opening 442 extending through each arm 440.

As illustrated in FIGS. 20 and 22, the arms 440 are located substantially mid-length of the base 402. However, this configuration is merely exemplary and the arms 440 can be disposed at other locations along the base 402.

Referring to FIG. 20, the receiving attachment member 450 may include a first body portion 452 and a second body portion 456 that are connected to one another. In addition, opposite end portions of the second body portion 456 of the receiving attachment member 450 are respectively inserted into the openings 442 of the arms 440 in order to hingedly connect the receiving attachment member 450 with the base 402.

As illustrated in FIG. 20, the first body portion 452 of the receiving attachment member 450 may have a cavity 462 for selectively connecting an extension pole to the receiving attachment member 450.

Therefore, by connecting a pole to the receiving attachment member 450, the sanding device 400 may be utilized to sand surfaces that a user cannot readily reach unaided. In addition, the dual hinge configuration of the receiving attachment member 450 allows for three-dimensional articulation of the sanding device 400 while connected to the pole, which further increases the utility of the apparatus 400.

As shown in FIG. 21, like the sanding device 300, the sanding device 400 includes recessed openings 474 in which the head of the fasteners 406 can be arranged. The recessed openings 474 are shown as being hexagonal to match the shape of the head of the fasteners 406. However, as long as the shape of the openings 474 and head of the fasteners 406 remain consistent, they both can be any shape that is non-circular.

FIGS. 23-28 are various view of the assembly of the sanding device 400. It is noted that the assembly of the sanding device 300 (not depicted) is the same as the assembly of the sanding device 400.

Figure 23:
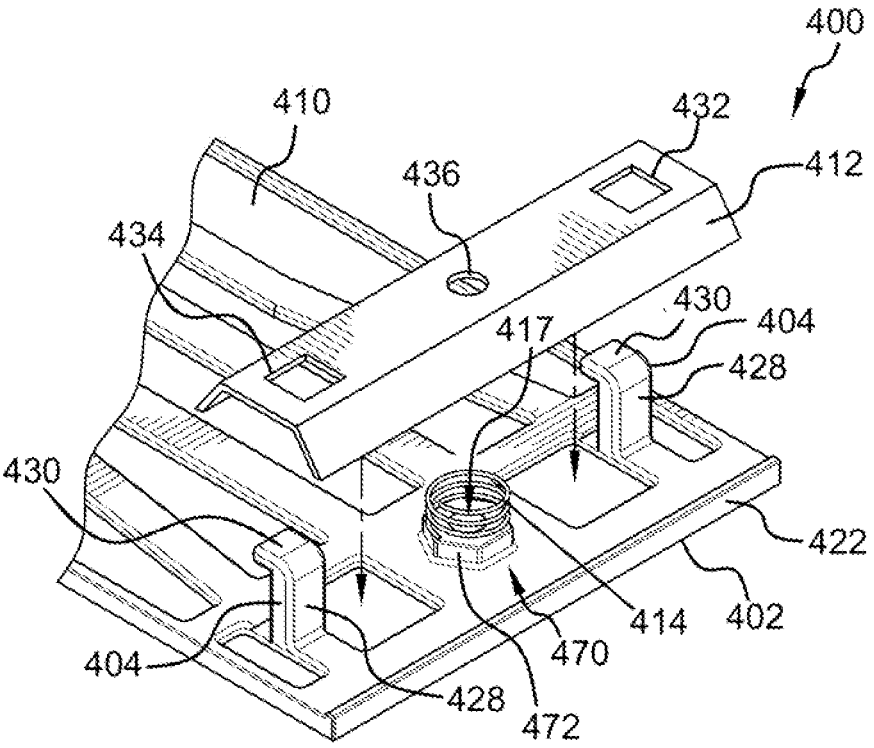
FIGS. 23-28 are partial perspective views illustrating a process of assembling the sanding device of FIG. 17 according to an embodiment of the present disclosure.

Referring to FIG. 23, the spring 414 is disposed over or around the projection 470. Then, as indicated by the two directional arrows in FIG. 23, the clamping mechanism 412 may be moved toward the base 402 of the sanding device 400 and cover the spring 414 by aligning the first and second openings 432 and 434, respectively, of the clamping mechanism 412 with the pair of protrusions 404.

Figure 24:
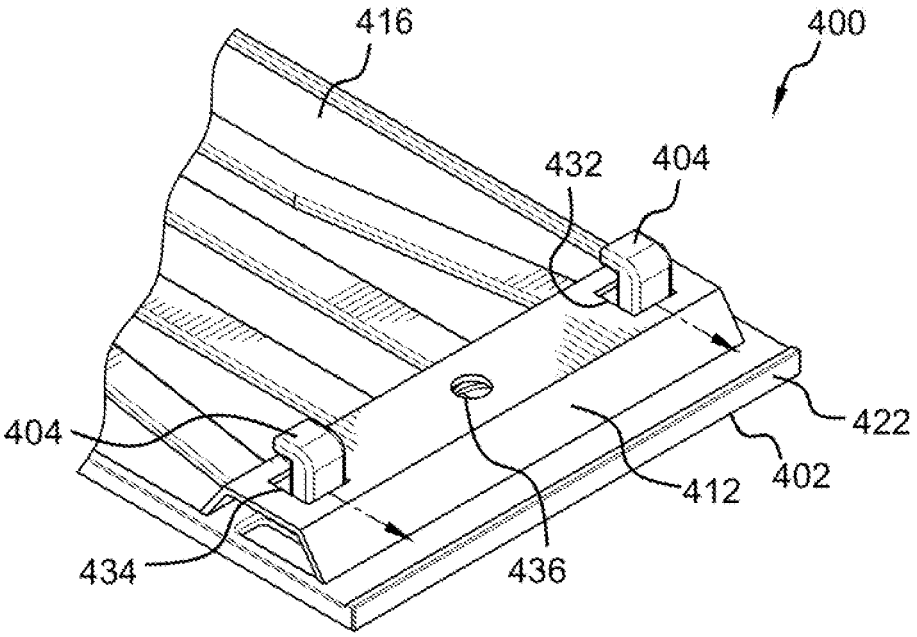
Figure 25:
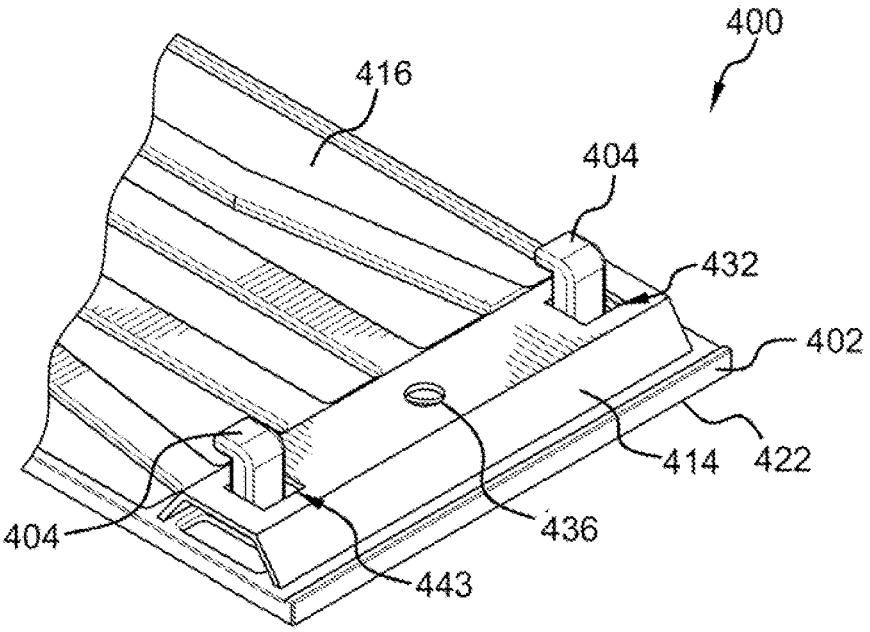

The resulting structure is illustrated in FIG. 24. Here, the spring 414 is compressed by the clamping mechanism 412. As indicated by the two directional arrows in FIG. 24, in order to misalign the first and second openings 432 and 434 with the second legs 430 of their respective protrusions 404 and secure the clamping mechanism 412 to the base 402, the clamping mechanism 412 is moved in a direction toward the first sidewall 422 as can be seen in FIG. 25 (while not shown, the clamping mechanism 412 is moved toward the second sidewall 424 as well).

If desired, a user may then relieve downward pressure applied to the clamping mechanism 412. When downwardly pressure is relieved, the clamping mechanism 412 may be elevated over the first surface 416 of the base 402 due to the upwardly force exerted thereon by the spring 414 until a top portion of the clamping mechanism 412 comes in contact with the second legs 430 of the protrusions 404. The second legs 430 of the protrusions 404 would prevent the clamping mechanism 412 from being lifted upwardly any further, thereby ensuring that the clamping mechanism 412 is not disengaged from the protrusions 404, and prevented or at least substantially prevented from rotating.

A user can advantageously utilize the vertical gap created by the elevation of the clamping mechanism 412 over the first surface 416 of the base 402 (due to the force applied by the spring 414), to load or unload a sheet of sandpaper in between the first surface 416 of the base 402 and the clamping mechanism 412. The sheet of sandpaper can then be orientated as needed.

Figure 26:
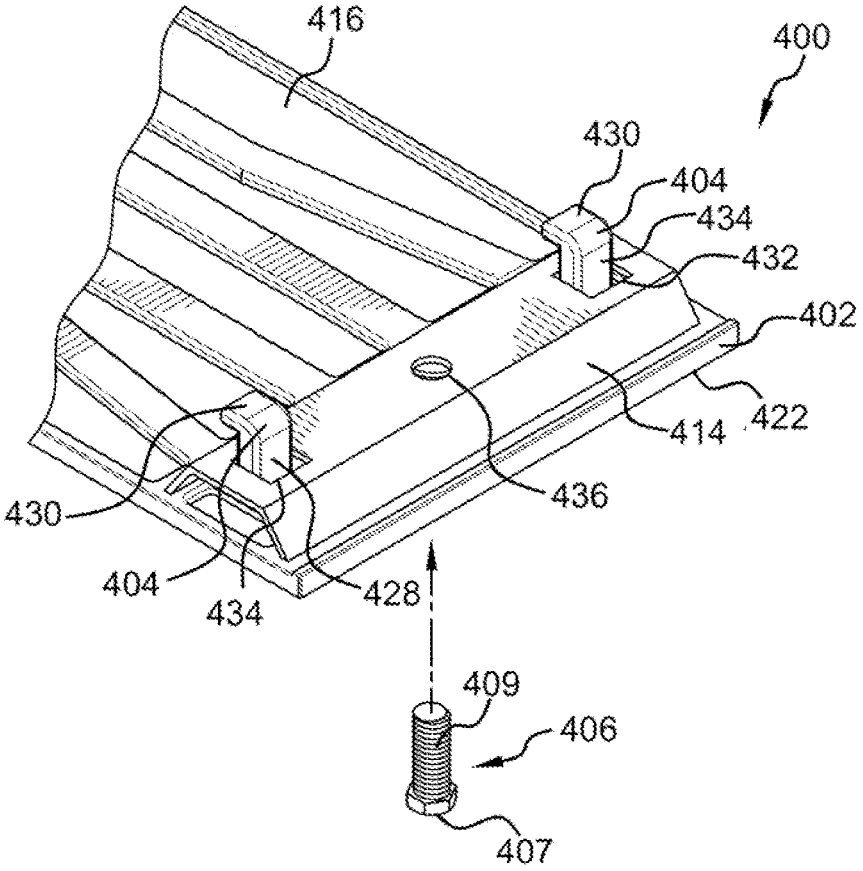
Figure 27:
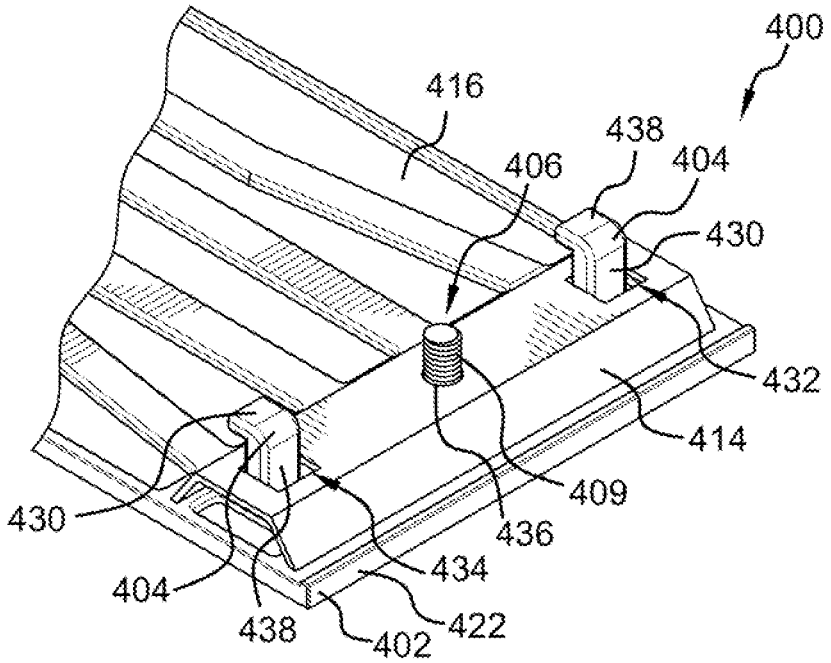

As depicted in FIG. 26, the first fastener 406 (e.g., screw) can be inserted into the recessed opening 474 and through the opening 417 extending between the recessed opening 474 and the projection 470 from the second surface 418 of the base 402, as illustrated by the directional arrow, with the threaded portion 419 of the fastener 406 extending through the opening 417. FIG. 27 shows the fastener 406 extended through the opening 417 of the base 402 and the opening 436 of the clamping mechanism 412.

Figure 28:
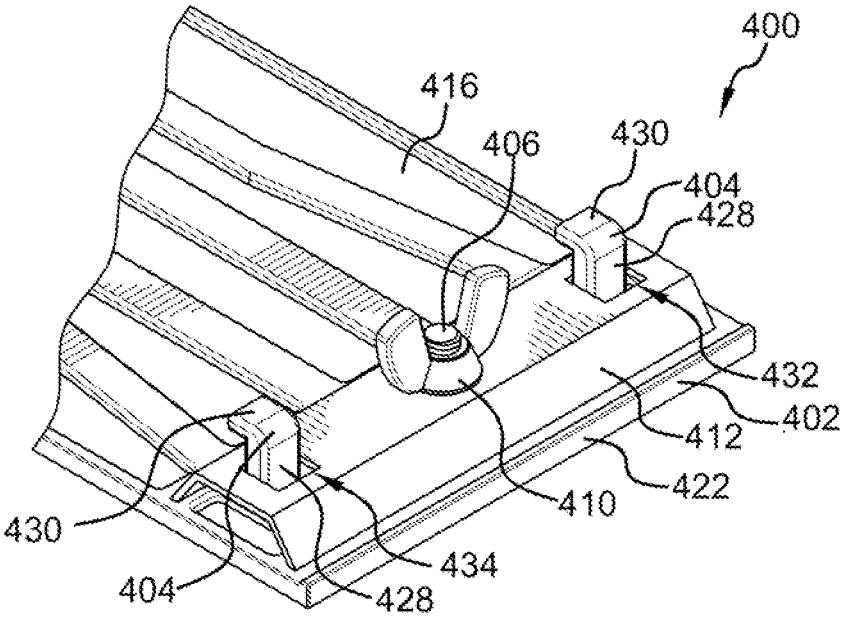

FIG. 28 shows the fastener 406 threadably connected to the second fastener 410 to ensure a secure contact between the clamping mechanism 412 and the base 402 between which a sheet of sandpaper can be secured.

Advantageously, no additional fastener is needed to secure the fastener 406 to the base 402 prior to selectively connecting the fastener 410 to the fastener 406 because the shape of the head 407 of the fastener 406 and the shape of the projection 470 prevent the fastener 406 from being disengaged during the threading of the fastener 410 therewith.

While in the example above it illustrated that the first fastener 406 is inserted upwardly to be connected with the second fastener 410 after the clamping mechanism 412 has been engaged with the protrusions 404, the present invention is not limited to this method of assembly. For example, the first fastener 406 may also be inserted upwardly to be selectively connected to the second fastener 410 prior to connecting the clamping mechanism 412 with the protrusions 404.

When a user desires to remove a sheet of sandpaper from the sanding device 400, the user can selectively disconnect (e.g., unthread) the second fastener 410 from the first fastener 406. When the third fastener 410 is disconnected from the first fastener 406, the clamping mechanism 412 would be lifted upwardly from the base 402 due to the force of the spring 414 acting thereon, thereby facilitating the sandpaper removal process. Advantageously, the protrusions 404 prevent the clamping mechanism 412 from being disconnected from (or disengaged with) the protrusions 404 in this state, and also at least substantially prevent the clamping mechanism 412 from being rotated such that a user would not need to use a hand to press down on the clamping mechanism 412 to ensure that it does not fall off the base 402 when the second fastener 410 is disconnected from the first fastener 406. With the exception of a pole that can be selectively connected to the device 400, the description above applies to a method of assembling the device 300 as well.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claimed is:

1. A sanding device, comprising:

a base having a first surface and a second surface that is mirror opposite the first surface and is delimited by a first sidewall, a second sidewall that is spaced from the first sidewall, a third sidewall that extends between the first sidewall and the second sidewall and a fourth sidewall that is spaced from the third sidewall and extends between the first sidewall and the second sidewall, the third sidewall and the fourth sidewall having a length that is greater than the first sidewall and the second sidewall;

at least one pair of protrusions extending directly from the base that are spaced from each other and spaced inward from one of the first sidewall and the second sidewall between a center of the base and the one of the first sidewall and the second sidewall, the at least one pair of protrusions each having a first leg extending from the base and a second leg, spaced from the base and extending from and perpendicular to the first leg and the base in a direction toward the one of the first sidewall and the second sidewall;

a plurality of fasteners, including a first one of the plurality of fasteners extending through the base;

a clamping mechanism having a first opening, a second opening and a third opening with a first one of the protrusions of the at least one pair of protrusions extending through the first opening, the first one of the plurality of fasteners extending through the second opening and a second one of the protrusions of the at least one pair of protrusions extending through the third opening; and a spring arranged over the first one of the plurality of fasteners, between the base and the first clamping mechanism;

wherein, in a first state, the clamping mechanism is releasably fixed in contact with the base by a second one of the plurality of fasteners that is secured to the first one of the plurality of fasteners, the first one of the protrusions of the at least one pair of protrusions extends through the first opening of the clamping mechanism, the second one of the protrusions of the pair of protrusions extends through the third opening of the clamping mechanism with the second leg of each of the protrusions of the pair of protrusions extending over the clamping mechanism, beyond the first opening and the third opening of the clamping mechanism, respectively, and, in a second state, the clamping mechanism is spaced away from the base when the second one of the plurality of fasteners is moved in a direction away from the base causing the spring to lift the clamping mechanism away from the base while the clamping mechanism is retained with respect to the base by the second arm of each of the protrusions of the at least one pair protrusions to substantially prevent axial rotation of the clamping mechanism with each of the protrusions of the at least one pair of protrusions continuously extending through the first opening and the third opening, respectively, in the first clamping mechanism in both the first state and the second state.

2. The sanding device of claim 1, wherein the at least one pair of protrusions includes a first pair of protrusions that are spaced from each other inwards of the first sidewall and a second pair of protrusions that are spaced from each other inwards of the second sidewall.

3. The sanding device of claim 1, wherein a recessed opening extends from the second surface of the base toward the first surface of the base.

4. The sanding device of claim 3, wherein the first one of the plurality of fasteners has a head that is arranged in the recessed opening.

5. The sanding device of claim 1, wherein the first one of the plurality of fasteners has a non-circular head.

6. The sanding device of claim 1, further comprising a projection extending from the base in a same direction as the at least one pair of protrusions, the projection having an opening extending therethrough.

7. The sanding device of claim 6, wherein the projection is formed integral with the base.

8. The sanding device of claim 1, wherein the at least one pair of protrusions are formed integral with the base.

9. The sanding device of claim 1, further comprising a receiving attachment member, wherein the at least one pair of protrusions includes a third protrusion and a fourth protrusion spaced apart from the third protrusion, the third protrusion and the fourth being different from the at least one a pair of the protrusions that extend from the base to substantially prevent axial rotation of the clamping mechanism, the third and fourth protrusions extending from the base and being configured to hingedly connect the base with the receiving attachment member.

10. The sanding device of claim 8, wherein the receiving attachment member includes a first body portion, a second body portion, and a shaft hingedly connecting the first and second body portions with one another.

11. The sanding device of claim 1, further comprising wherein the at least one pair of protrusions further comprising a second pair of protrusions extending directly from the base that are spaced from each other and spaced inward from one of the first sidewall and the second sidewall, between the center of the base and the first sidewall and the second sidewall, the second pair of protrusions each having a first leg and a second leg that is spaced from the base, extending from and perpendicular to the first leg and the base in a direction toward one of the first sidewall and the second sidewall, a second clamping mechanism having a fourth opening, a fifth opening and a sixth opening with the a first one of the protrusions of the second pair of protrusions extending through the fourth opening, a third one of the plurality of fasteners extending through the fifth opening and a second one of the protrusions of the second pair of protrusions extending through the sixth opening, a second spring arranged over the third one of the plurality of fasteners, between the base and the second clamping mechanism, wherein, the second clamping mechanism, in a first state thereof, is releasably fixed in contact with the base by a fourth one of the plurality of fasteners that is secured to the third one of the plurality of fasteners, the first one of the protrusions of the second pair of protrusions extends through the first opening of the second clamping mechanism, the second one of the protrusions of the second pair of protrusions extends through the third opening of the clamping mechanism with the second arm of each of the protrusions of the second pair of protrusions extending over the second clamping mechanism, beyond the first opening and the third opening of the second clamping mechanism, respectively, and, the second clamping mechanism, in a second state thereof, is spaced away from the base when the fourth one of the plurality of fasteners is moved in a direction away from the base causing the second spring to lift the second clamping mechanism away from the base while the second clamping mechanism is retained with respect to the base by the second arm of each of the protrusions of the second pair protrusions to substantially prevent axial rotation of the second clamping mechanism with each of the protrusions of the second pair of protrusions continuously extending through the fourth opening and the sixth opening, respectively, in the second clamping mechanism in both the first state and the second state.

12. A method of assembling a sanding device, comprising the following steps:

providing a sanding device that includes a base having a first surface and a second surface that is mirror opposite the first surface and is delimited by a first sidewall, a second sidewall that is spaced from the first sidewall, a third sidewall that extends between the first sidewall and the second sidewall and a fourth sidewall that is spaced from the third sidewall and extends between the first sidewall and the second sidewall, the third sidewall and the fourth sidewall having a length that is greater than the first sidewall and the second sidewall, a pair of protrusions extending directly from the base that are spaced from each other and spaced inward from one of the first sidewall and the second sidewall between a center of the base and one of the first sidewall and the second sidewall, the pair of protrusions each having a first leg extending from the base and a second leg, spaced from the base and extending from and perpendicular to the first leg and the base in a direction toward one of the first sidewall and the second sidewall; a plurality of fasteners, including a first one of the plurality of fasteners extending through the base; a clamping mechanism having a first opening, a second opening and a third opening and a spring;

arranging the first one of the plurality of fasteners through an opening in the base inward from one of the first sidewall and the second sidewall of the base such that the first one of the plurality fasteners extends above the base in a same direction the pair of protrusions;

arranging the spring over the first one of the plurality of fasteners;

orientating the clamping mechanism such a first one of the protrusions of the pair of protrusions extends through the first opening of the clamping mechanism, the first one of the plurality of fasteners extends through the second opening of the clamping mechanism, and a second one of the protrusions of the pair of protrusions extends through the third opening of the clamping mechanism;

and releasably fixing the clamping mechanism in contact with the base in a first state with a second one of the plurality of fasteners interacting with the first one of the plurality of fasteners and the first leg and the second leg of each of the protrusions of the pair of protrusions extend through the clamping mechanism with the second arm of each of the protrusions spaced from the clamping mechanism and extend over the clamping mechanism, and, in a second state, the clamping mechanism being spaced away from the base while the clamping mechanism is retained with respect to the base by the second leg of the first one of protrusions of the pair of protrusions and the second leg of the second one of the protrusions of the pair of protrusions to substantially prevent axial rotation of the clamping mechanism with each of the first one of the protrusions and the second one of the protrusions of the pair of protrusions continuously extending through the first openings and the third one openings, respectively, in both the first state and the second state.

13. The method of claim 10, wherein the first leg has a length greater than the height of the clamping mechanism to allow the clamping mechanism to be spaced away from the base in the second state, and the second leg is configured to selectively prevent the clamping mechanism from being disconnected from the sanding device in the second state.

14. The method of claim 10, wherein the plurality of fasteners of the sanding device further includes a third one of the plurality of fasteners, the method further including the step of releasably fixing the third one of the plurality of fasteners with the first one of the plurality of fasteners prior to the step of releasably fixing the clamping mechanism in contact with the base.

15. The method of claim 10, wherein the base of the sanding device further includes a projection extending from the base in a same direction as the pair of protrusions, the opening in the base passing through a recessed opening, wherein the projection includes an outer surface and an inner surface opposite to the outer surface, wherein the inner surface defines a chamber, wherein the first one of the plurality of fasteners includes a head with a shape matching a shape of the chamber and being configured to fit in the chamber, and a threaded body extending from the head, and wherein the step of arranging the first one of the plurality of fasteners through the opening in the base includes arranging the head of the first one of the plurality of fasteners in the projection with the threaded body thereof passing through the opening in the base.

16. The method of claim 10, wherein the sanding device further includes a receiving attachment member configured to be selectively connected to an extension pole, wherein the plurality of protrusions includes a third protrusion and the fourth protrusion spaced apart from the third protrusion, wherein the third a fourth protrusions are different from the pair of the protrusions that substantially prevent axial rotation of the clamping mechanism, wherein the third and fourth protrusions extend from the base, and the third and fourth protrusions are configured to hingedly connect the base with the receiving attachment member.

* * * * *